US006289311B1

(12) United States Patent
Omori et al.

(10) Patent No.: US 6,289,311 B1
(45) Date of Patent: Sep. 11, 2001

(54) SOUND SYNTHESIZING METHOD AND APPARATUS, AND SOUND BAND EXPANDING METHOD AND APPARATUS

(75) Inventors: Shiro Omori; Masayuki Nishiguchi, both of Kangawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/175,616

(22) Filed: Oct. 20, 1998

(30) Foreign Application Priority Data

Oct. 23, 1997 (JP) ..... 09-291405

(51) Int. Cl.[7] ..... G10L 13/02
(52) U.S. Cl. ..... 704/268; 704/266; 704/208
(58) Field of Search ..... 704/268, 264, 704/217, 200, 230, 222, 219, 262, 267, 266, 258, 208, 214

(56) References Cited

U.S. PATENT DOCUMENTS

| | | | | |
|---|---|---|---|---|
| 5,581,652 | | 12/1996 | Abe et al. | 395/2.31 |
| 5,864,797 | * | 1/1999 | Fujimoto | 704/223 |
| 5,890,105 | * | 3/1999 | Ishihara et al. | 704/201 |
| 6,003,001 | * | 12/1999 | Maeda | 704/223 |

FOREIGN PATENT DOCUMENTS

| | | | |
|---|---|---|---|
| 0658874 | 12/1994 | (EP) | G10L/9/02 |
| 0732687 | 9/1996 | (EP) | G10L/9/14 |
| 0838804 | 4/1998 | (EP) | G10L/3/02 |

OTHER PUBLICATIONS

Record Fourth IEEE International Conference on Universal Personal Communication. Ishikawa et al., "A 16 bit low power–consumption digital signal processor for portable Terminl" pp 798–802. Nov. 1995.*

IEEE Signal Processing Society. Worshop on VLSI Signal Processing, VIII, 1995. Ohta et al., Efficient PSI–CELP DSP Implementation, pp 99–107. Sep. 1995.*

* cited by examiner

*Primary Examiner*—Richemond Dorvil
(74) *Attorney, Agent, or Firm*—Jay H. Maioli

(57) ABSTRACT

A method and apparatus for sound synthesizing and sound band expanding of a narrow band input signal uses wide-band voiced and unvoiced sound code books and also uses narrow-band voiced and unvoiced sound code books. Coded input sound parameters are decoded and quantized using the narrow-band voiced and unvoiced sound code books and are then de-quantized using the wide-band voiced and unvoiced sound code books. The sound is synthesized based on the de-quantized data and a so-called innovation-related parameter formed by a zero-filling circuit filing zeros between samples of the framed input signal, so that the result is an upsampled aliased wide-band signal used with the de-quantized data to synthesize the sound.

38 Claims, 14 Drawing Sheets

SOUND SYNTHESIZING METHOD AND APPARATUS, AND SOUND BAND EXPANDING METHOD AND APPARATUS

BACKGROUND OF THE INVENTION

1. Field of the Invention

The present invention relates to a method of, and an apparatus for, synthesizing a sound from coded parameters sent from a transmitter, and also to a method of, and an apparatus for, expanding the band of a narrow frequency-band sound or speech signal transmitted to a receiver from the transmitter over a communications network such as a telephone line or broadcasting network, while keeping the frequency band unchanged over the transmission path.

2. Description of Related Art

The telephone lines are regulated to use a frequency band as narrow as 300 to 3,400 Hz, for example, and the frequency band of a sound signal transmitted over the telephone network is thus limited. Therefore, the conventional analog telephone line may not be said to assure a good sound quality. This is also true for the digital portable telephone.

However, since the standards, regulations and rules for the telephone transmission path are already strictly defined, it is difficult to expand the frequency band for such specific communications. In these situations, there have been proposed various approaches to generate a wide-band signal by predicting out-of-band signal components at the receiver. Among such technical proposals, an approach to overcome such a difficulty by using a sound code book mapping is considered the best for a good sound quality. This approach is characterized by that two sound code books for sound analysis and synthesis are used to predict a spectrum envelope of a wide-band sound from a one of a narrow-band sound supplied to the receiver.

More particularly, the above approach uses the Linear Predictive Code (LPC) cepstrum, a well-known parameter for representation of a spectrum envelope, to pre-form two sound code books, one for a narrow-band sound and the other for a wide-band sound. There exist one-to-one correspondences between code vectors in these two sound code books. A narrow-band LPC cepstrum is determined from an input narrow-band sound, quantized in vector by comparison with a code vector in the narrow-band sound code book, and dequantized using a corresponding code vector in the wide-band sound code book, to thereby determine a wide-band LPC cepstrum.

For the one-to-one correspondence between the code vectors, the two sound code books are generated as will be described below. First, a wide-band learning sound is prepared, and it is limited in bandwidth to provide a narrow-band learning sound as well. The wide- and narrow-band learning sounds thus prepared are framed, respectively, and an LPC cepstrum determined from the narrow-band sound is used to first learn and generate a narrow-band sound code book. Then, frames of a learning wide-band sound corresponding to the resultant learning narrow-band sound frames to be quantized to a code vector are collected, and weighted to provide wide-band code vectors from which a wide-band sound code book is formed.

As another application of this approach, a wide-band sound code book may first be generated from the learning wide-band sound, and then corresponding learning narrow-band sound frames are weighted to provide narrow-band code vectors from which a narrow-band sound code book is generated.

Further, there has also been proposed a sound code book generation mode in which an autocorrelation is used as a parameter to be a code vector. Also, innovations are requisite for the LPC analysis and synthesis. Such innovations include a set of an impulse train and noise, an upsampled narrow-band innovation, etc.

The application of the aforementioned approaches have not succeeded in attaining a satisfactory sound quality. In particular, the sound quality is remarkably poor when the approach is applied for a sound encoded in the low bit rate sound encoding mode such as the Vector Sum Excited Linear Prediction (VSELP) mode, Pitch Synchronous Innovation-Code Excited Linear Prediction (PSI-CELP) mode or the like included in the so-called sound encoding mode CELP (Code Excited Linear Prediction) adopted in the digital telephone systems currently prevailing in Japan.

Also, the size of the memory used in generating the narrow- and wide-band sound code books is insufficient.

SUMMARY OF THE INVENTION

Accordingly, the present invention has an object to overcome the above-mentioned drawbacks of the prior art by providing a sound synthesizing method and apparatus, and a band expanding method and apparatus, adapted to provide a wide-band sound having a good quality for hearing.

To overcome the above-mentioned drawbacks of the prior art, the present invention has another object to provide a sound synthesizing method and apparatus, and a band expanding method and apparatus, adapted to save the memory capacity by using a sound code book for both sound analysis and synthesis.

The above object can be achieved by providing a sound synthesizing method in which, to synthesize a sound from plural kinds of input coded parameters, there are adopted a wide-band voiced sound code book and a wide-band unvoiced sound code book pre-formed from voiced and unvoiced sound characteristic parameters, respectively, extracted from wide-band voiced and unvoiced sounds separated at every predetermined time unit, and a narrow-band voiced sound code book and a narrow-band unvoiced sound code book pre-formed from voiced and unvoiced sound characteristic parameters extracted from a narrow-band sound obtained by limiting the frequency band of the separated wide-band voiced and unvoiced sounds, comprising, according to the present invention, the steps of decoding the plural kinds of coded parameters;

forming an innovation from a first one of the plural kinds of decoded parameters;

converting a second decoded parameter to a sound synthesis characteristic parameter;

discriminating between the voiced and unvoiced sounds discriminable with reference to a third decoded parameter;

quantizing the sound synthesis characteristic parameter based on the result of the discrimination by using the narrow-band voiced and unvoiced sound code books;

dequantizing, by using the wide-band voiced and unvoiced sound code books, the narrow-band voiced and unvoiced sound data having been quantized using the narrow-band voiced and unvoiced sound code books; and synthesizing a sound based on the dequantized data and innovation.

The above object can also be achieved by providing a sound synthesizing apparatus which uses, to synthesize a sound from plural kinds of input coded parameters, a wide-band voiced sound code book and a wide-band unvoiced sound code book pre-formed from voiced and unvoiced sound characteristic parameters, respectively, extracted from wide-band voiced and unvoiced sounds separated at every predetermined time unit, a narrow-band voiced sound code book and a narrow-band unvoiced sound code book pre-formed from voiced and unvoiced sound characteristic parameters extracted from a narrow-band sound obtained by limiting the frequency band of the separated wide-band voiced and unvoiced sounds, comprising, according to the present invention:

means for decoding the plural kinds of coded parameters;

means for forming an innovation from a first one of the plural kinds of parameters decoded by the decoding means;

means for obtaining a sound synthesis characteristic parameter from a second one of the coded parameters decoded by the decoding means;

means for discriminating between the voiced and unvoiced sounds with reference to a third one of the coded parameters decoded by the decoding means;

means for quantizing the sound synthesis characteristic parameter based on the result of the discrimination of the voiced and unvoiced sounds by using the narrow-band voiced and unvoiced sound code books;

means for dequantizing the quantized voiced and unvoiced sound data from the voiced and unvoiced sound quantizing means by using the wide-band voiced and unvoiced sound code books; and means for synthesizing a sound based on the dequantized data from the wide-band voiced and unvoiced sound dequantizing means and the innovation from the innovation forming means.

The above object can also achieved by providing a sound synthesizing method in which, to synthesize a sound from plural kinds of input coded parameters, there is used a wide-band sound code book pre-formed from a characteristic parameter extracted from wide-band sounds at every predetermined time unit, comprising, according to the present invention, the steps of:

decoding the plural kinds of coded parameters;

forming an innovation from a first one of the plural kinds of decoded parameters;

converting a second decoded parameter to a sound synthesis characteristic parameter;

calculating a narrow-band characteristic parameter from each code vector in the wide-band sound code book;

quantizing the sound synthesis characteristic parameter by comparison with the narrow-band characteristic parameter provided by the calculating means;

dequantizing the quantized data by using the wide-band sound code book; and synthesizing a sound based on the dequantized data and innovation.

The above object can also achieved by providing a sound synthesizing apparatus which uses, to synthesize a sound from plural kinds of input coded parameters, wide-band sound code book pre-formed from a characteristic parameter extracted from wide-band sounds at every predetermined time unit, comprising, according to the present invention:

means for decoding the plural kinds of coded parameters;

means for forming an innovation from a first one of the plural kinds of parameters decoded by the decoding means;

means for converting a second decoded parameter of the plural kinds of parameters decoded by the decoding means to a sound synthesis characteristic parameter;

means for calculating a narrow-band characteristic parameter from each code vector in the wide-band sound code book;

means for quantizing the sound synthesis characteristic parameter from the parameter converting means by using the narrow-band characteristic parameter from the calculating means;

means for dequantizing the quantized data from the quantizing means by using the wide-band sound code book; and means for synthesizing a sound based on the dequantized data from the dequantizing means and the innovation from the innovation forming means.

The above object can also achieved by providing a sound synthesizing method in which, to synthesize a sound from plural kinds of input coded parameters, there is used a wide-band sound code book pre-formed from a characteristic parameter extracted from wide-band sounds at every predetermined time unit, comprising, according to the present invention, the steps of:

decoding the plural kinds of coded parameters;

forming an innovation from a first one of the plural kinds of decoded parameters;

converting a second decoded parameter to a sound synthesis characteristic parameter;

calculating a narrow-band characteristic parameter, by partial extraction, from each code vector in the wide-band sound code book;

quantizing the sound synthesis characteristic parameter by comparison with the narrow-band characteristic parameter extracted by the calculating means;

dequantizing the quantized data by using the wide-band sound code book; and synthesizing a sound based on the dequantized data and innovation.

The above object can also achieved by providing a sound synthesizing apparatus which uses, to synthesize a sound from plural kinds of input coded parameters, a sound a wide-band sound code book pre-formed from a characteristic parameter extracted from wide-band sounds at every predetermined time unit, comprising, according to the present invention:

means for decoding the plural kinds of coded parameters;

means for forming an innovation from a first one of the plural kinds of parameters decoded by the decoding means;

means for converting a second decoded parameter of the plural kinds of parameters decoded by the decoding means to a sound synthesis characteristic parameter;

means for calculating a narrow-band characteristic parameter, by partial extraction, from each code vector in the wide-band sound code book;

means for quantizing the sound synthesis characteristic parameter from the parameter converting means by using the narrow-band characteristic parameter from the calculating means;

means for dequantizing the quantized data from the quantizing means by using the wide-band sound code book; and means for synthesizing a sound based on the dequantized data from the dequantizing means and the innovation from the innovation forming means.

The above object can be achieved by providing a sound band expanding method in which, to expand the band of an input narrow-band sound, there are used a wide-band voiced sound code book and a wide-band unvoiced sound code book pre-formed from voiced and unvoiced sound parameters, respectively, extracted from wide-band voiced and unvoiced sounds separated at every predetermined time unit, and a narrow-band voiced sound code book and a narrow-band unvoiced sound code book pre-formed from voiced and unvoiced sound characteristic parameters extracted from a narrow-band sound obtained by limiting the frequency band of the separated wide-band voiced and unvoiced sounds, comprising, according to the present invention, the steps of:

discriminating between a voiced sound and unvoiced sound in the input narrow-band sound at every predetermined time unit;

generating a voiced parameter and unvoiced parameter from the narrow-band voiced and unvoiced sounds;

quantizing the narrow-band voiced and unvoiced sound parameters of the narrow-band sound by using the narrow-band voiced and unvoiced sound code books;

dequantizing, by using the wide-band voiced and unvoiced sound code books, the narrow-band voiced and unvoiced sound data having been quantized using the narrow-band voiced and unvoiced sound code books; and expanding the band of the narrow-band sound based on the dequantized data.

The above object can also be achieved by providing a sound band expanding apparatus which uses, to expand the band of an input narrow-band sound, a wide-band voiced sound code book and a wide-band unvoiced sound code book pre-formed from voiced and unvoiced sound parameters, respectively, extracted from wide-band voiced and unvoiced sounds separated at every predetermined time unit, and a narrow-band voiced sound code book and a narrow-band unvoiced sound code book pre-formed from voiced and unvoiced sound characteristic parameters extracted from a narrow-band sound obtained by limiting the frequency band of the separated wide-band voiced and unvoiced sounds, comprising, according to the present invention:

means for discriminating between a voiced sound and unvoiced sound in the input narrow-band sound at every predetermined time unit;

means for generating a voiced parameter and unvoiced parameter from the narrow-band voiced and unvoiced sounds discriminated by the voiced/unvoiced sound discriminating means;

means for quantizing the narrow-band voiced and unvoiced sound parameters from the narrow-band voiced and unvoiced sound parameter generating means by using the narrow-band voiced and unvoiced sound code books; and means for dequantizing, by using the wide-band voiced and unvoiced sound code books, the narrow-band voiced and unvoiced sound data from the narrow-band voiced and unvoiced sound quantizing means by using the narrow-band voiced and unvoiced sound code books;

the band of the narrow-band sound being expanded based on the dequantized data from the wide-band voiced and unvoiced sound dequantizing means.

The above object can also achieved by providing a sound band expanding method in which, to expand the band of an input narrow-band sound, there is used a wide-band sound code book pre-formed from a parameter extracted from wide-band sounds at every predetermined time unit, comprising, according to the present invention, the steps of:

generating a narrow-band parameter from the input narrow-band sound;

calculating a narrow-band parameter from each code vector in the wide-band sound code book;

quantizing the narrow-band parameter generated from the input narrow-band sound by comparison with the calculated narrow-band parameter;

dequantizing the quantized data by using the wide-band sound code book; and expanding the band of the narrow-band sound based on the dequantized data.

The above object can also achieved by providing a sound band expanding apparatus which, to expand the band of an input narrow-band sound, uses a wide-band sound code book pre-formed from parameters extracted from wide-band sounds at every predetermined time unit, comprising, according to the present invention:

means for generating a narrow-band parameter from the input narrow-band sound;

means for calculating a narrow-band parameter from each code vector in the wide-band sound code book;

means for quantizing the narrow-band parameter from the input narrow-band parameter generating means by comparison with the narrow-band parameter from the narrow-band parameter calculating means; and means for dequantizing the quantized narrow-band data from the narrow-band sound quantizing means by using the wide-band sound code book; and the band of the narrow-band sound being expanded based on the dequantized data from the wide-band sound dequantizing means.

The above object can also be achieved by providing a sound band expanding method in which, to expand the band of the input narrow-band sound, there is used a wide-band sound code book pre-formed from a parameter extracted from wide-band sounds at every predetermined time unit, comprising, according to the present invention, the steps of:

generating a narrow-band parameter from the input narrow-band sound;

calculating a narrow-band parameter, by partial extraction, from each code vector in the wide-band sound code book;

quantizing the narrow-band parameter generated from the input narrow-band sound by comparison with the calculated narrow-band parameter;

dequantizing the quantized data by using the wide-band sound code book; and expanding the band of the narrow-band sound based on the dequantized data.

The above object can also be achieved by providing a sound band expanding apparatus which uses, to expand the band of the input narrow-band sound, a wide-band sound code book pre-formed from a parameter extracted from wide-band sounds at every predetermined time unit, comprising, according to the present invention:

means for generating a narrow-band parameter from the input narrow-band sound;

means for calculating a narrow-band parameter, by partial extraction, from each code vector in the wide-band sound code book;

means for quantizing the narrow-band parameter from the narrow-band parameter generating means by using the narrow-band parameter from the narrow-band parameter calculating means; and means for dequantizing the quantized narrow-band data from the quantizing means by using the wide-band sound code book; and the band of the narrow-band sound being expanded based on the dequantized data from the dequantizing means.

BRIEF DESCRIPTION OF THE DRAWINGS

These objects and other objects, features and advantages of the present intention will become more apparent from the following detailed description of the present invention when taken in conjunction with the accompanying drawings, of which.

DETAILED DESCRIPTION OF THE PREFERRED EMBODIMENTS

Figure 1:
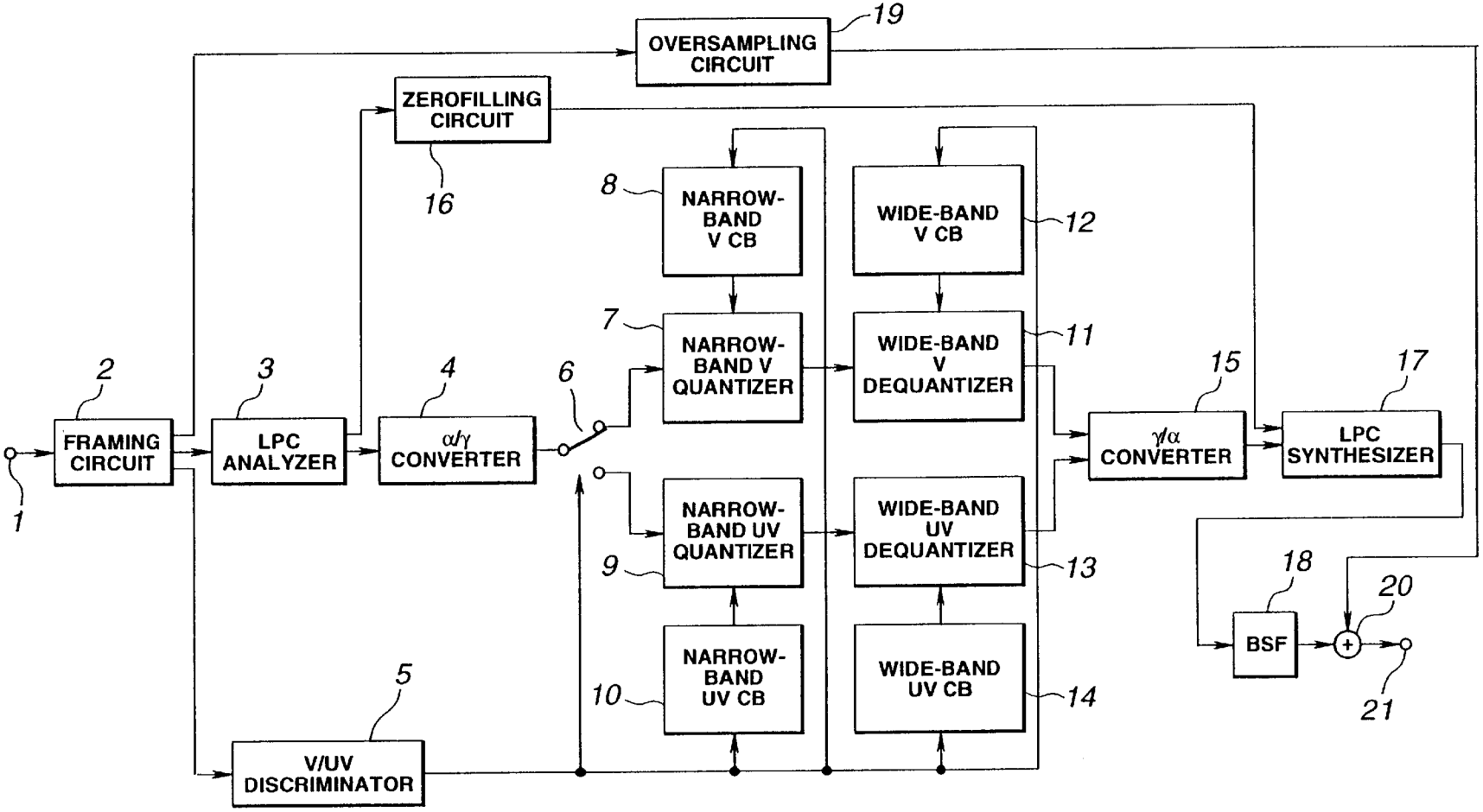
FIG. 1 is a block diagram of an embodiment of the sound band expander of the present invention.

Referring now to FIG. 1, there is illustrated the embodiment of the sound band expander of the present invention, adapted to expand the band of an narrow-band sound. Assume here that the sound band expander is supplied at an input thereof with a narrow-band sound signal having a frequency band of 300 to 3,400 Hz and a sampling frequency of 8 kHz.

The sound band expander according to the present invention has a wide-band voiced sound code book 12 and wide-band unvoiced sound code book 14, pre-formed using voiced and unvoiced sound parameters extracted from wide-band voiced and unvoiced sounds, a narrow-band voiced sound code book 8 and narrow-band unvoiced sound code book 10, pre-formed from voiced and unvoiced sound parameters extracted from narrow-band sound signal having a frequency band of 300 to 3,400 Hz, for example, produced by limiting the frequency band of the wide-band sound.

The sound band expander according to the present invention comprises a framing circuit 2 provided to frame the narrow-band sound signal received at the input terminal 1 at every 160 samples (one frame equals to 20 msec because the sampling frequency is 8 kHz), a zerofilling circuit 16 to form an innovation based on the framed narrow-band sound signal, a V/UV discriminator 5 to discriminate between a voiced sound (V) and unvoiced sound (UV) in the narrow-band sound signal at every frame of 20 msec, an LPC (linear prediction code) analyzer 31 to produce a linear prediction factor a for the narrow-band voiced and unvoiced sounds based on the result of the V/UV discrimination; an $\alpha/\gamma$ converter 4 to convert the linear prediction factor $\alpha$ from the LPC analyzer 3 to an autocorrelation $\gamma$, a kind of parameter, a narrow-band voiced sound quantizer 7 to quantize the narrow-band voiced sound autocorrelation $\gamma$ from the $\alpha/\gamma$ converter 4 using the narrow-band voiced sound code book 8, a narrow-band unvoiced sound quantizer 9 to quantize the narrow-band unvoiced sound autocorrelation $\gamma$ from the $\alpha/\gamma$ converter 4 using the narrow-band unvoiced sound code book 10, a wide-band voiced sound dequantizer 11 to dequantize the narrow-band voiced sound quantized data from the narrow-band voiced sound quantizer 7 using the wide-band voiced sound code book 12, a wide-band unvoiced sound dequantizer 13 to dequantize the narrow-band unvoiced quantized data from the narrow-band unvoiced sound quantizer 9 using the wide-band unvoiced sound code book 14, a $\gamma/\alpha$ converter 15 to convert the wide-band voiced sound autocorrelation (a dequantized data) from the wide-band voiced sound dequantizer 1I1 to a narrow-band voiced sound linear prediction factor, and the wide-band unvoiced sound autocorrelation (a dequantized data) from the wide-band unvoiced sound dequantizer 13 to a narrow-band unvoiced sound linear prediction factor, and an LPC synthesizer 17 to synthesize a wide-band sound based on the narrow-band voiced and unvoiced sound linear prediction factors from the $\gamma/\alpha$ converter 15 and the innovation from the zerofilling circuit 16.

The sound band expander further comprises an oversampling circuit 19 provided to change the sampling frequency of the framed narrow-band sound from the framing circuit 2 from 8 kHz to 16 kHz, a band stop filter (BSF) 18 to eliminate or remove a signal component of 300 to 3,400 Hz in frequency band of the input narrow-band voiced sound signal from a synthesized output from the LPC synthesizer 17, and an adder 20 to add to an output from the BSF filter 18 the signal component of 300 to 3,400 Hz in frequency band and 16 kHz in sampling frequency of the original narrow-band voiced sound signal from the oversampling circuit 19. The sound band expander delivers at an output terminal 21 thereof a digital sound signal having a frequency band of 300 to 7,000 Hz and the sampling frequency of 16 kHz.

Now, it will be described how the wide-band voiced and unvoiced sound code books 12 and 14 and the narrow-band voiced and unvoiced sound code books 8 and 10 are formed.

First, a wide-band sound signal having a frequency band of 300 to 7,000 Hz, for example, framed at every 20 msec, for example, as in the framing in the framing circuit 2, is separated into a voiced sound (V) and unvoiced sound (UV). A voiced sound parameter and unvoiced sound parameter are extracted from the voiced and unvoiced sounds, respectively, and used to create the wide-band voiced and unvoiced sound code books 12 and 14, respectively.

Also, for creation of the narrow-band voiced and unvoiced sound code books 8 and 10, the wide-band sound is limited in frequency band to produce a narrow-band voiced sound signal-having a frequency band of 300 to 3,400 Hz, for example, from which a voiced sound parameter and unvoiced sound parameter are extracted. The voiced and unvoiced sound parameters are used to produce the narrow-band voiced and unvoiced sound code books 8 and 10.

Figure 2:
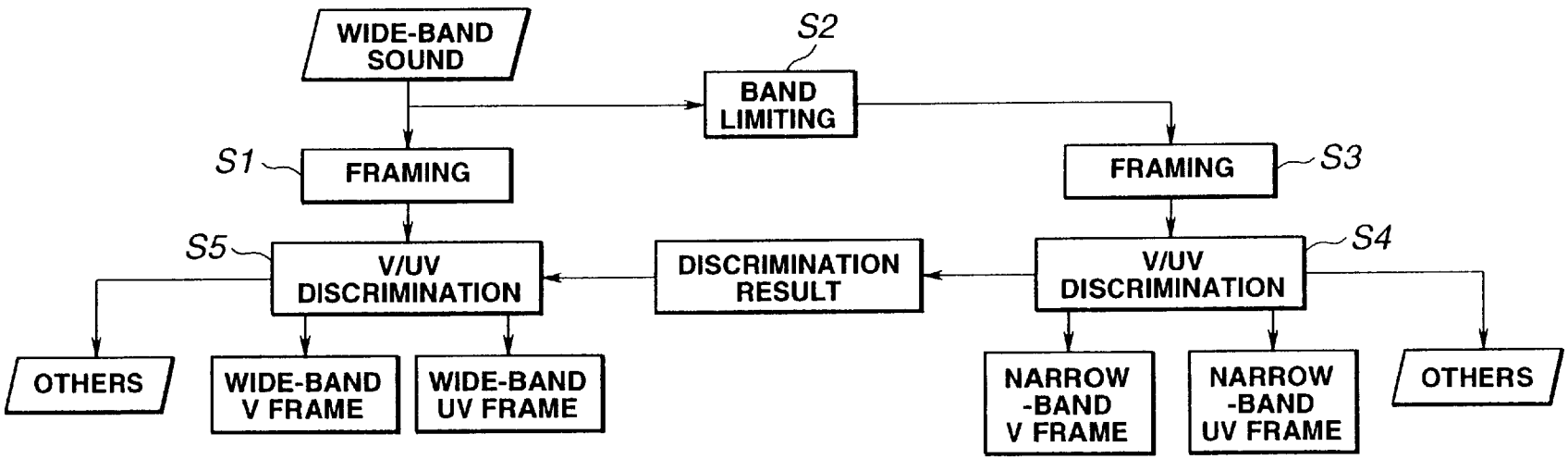
FIG. 2 is a flow chart of the generation of data for the sound code book used in the sound band expander in FIG. 2.

FIG. 2 is a flow chart of the preparation of learning data for creation of the above-mentioned four kinds of sound code books. As shown, a narrow-band learning sound signal is produced and framed at every 20 msec at Step S1. At Step S2, the wide-band learning sound signal is limited in band to produce a narrow-band sound signal. At Step S3, the narrow-band sound signal is framed at the same framing timing (20 msec/frame) as at Step S1. Each frame of the narrow-band sound signal is checked for frame energy and zero-cross, and the sound signal is judged at Step S4 to be a voiced signal (V) or an unvoiced one (UV).

For a higher-quality sound code book, a component in transition from a voiced sound (V) to unvoiced sound (UV) or vice versa, and a one difficult to discriminate between V and UV, are eliminated to provide only sounds being surely V and UV. Thus, a collection of learning narrow-band V frames and a collection of learning narrow-band UV frames are obtained.

Next, the wide-band sound frames are also classified into V and UV sounds. Since the wide-frames have been framed at the same timing as the narrow-band frames, however, the result of the classification is used to take, as V, wide-band frames processed at the same time as the narrow-band frame classified to be V in the discrimination of the narrow-band sound signal, and, as UV, wide-band frames processed at the same time as the narrow-band frame classified to be UV. Thus a learning data is generated. Needless to say, the frames not classified to be neither V nor UV in the narrow-band frame discrimination.

Also, a learning data can be produced in a contrary manner not illustrated. Namely, the V/UV classification is used on wide-band frames. The result of the classification is used to classify narrow-band frames to be V or UV.

Figure 3:
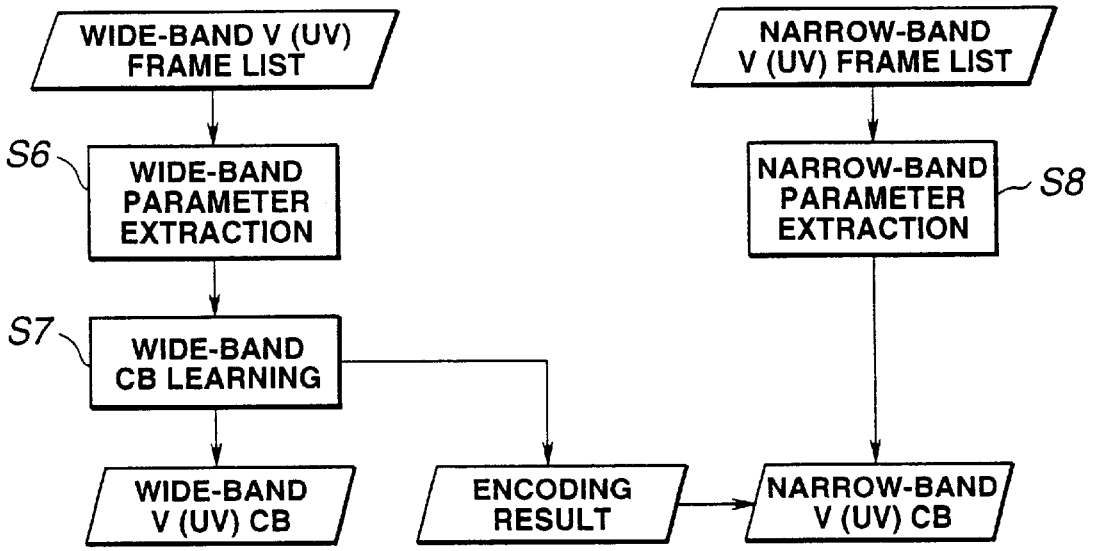
FIG. 3 is a flow chart of the generation of the sound code book used in the sound band expander in FIG. 1.

Next, the learning data thus produced are used to generate sound code books as shown in FIG. 3. FIG. 3 is a flow chart of the generation of the sound code book. As shown, a collection of wide-band V (UV) frames is first used to learn and generate a wide-band V (UV) sound code book.

First, autocorrelation parameters of up to dn dimensions are extracted from each wide-band frame as at Step S6. The autocorrelation parameter is calculated based on the following equation (1):

$$\phi(xi) = \left(\sum_{j=0}^{N-1-i} xjxj+1\right) \Big/ \left(\sum_{j=0}^{N-1} x2j\right) \tag{1}$$

where x is an input signal, f(xi) is an nth-order autocorrelation, and N is a frame length.

At Step S7, the Generalized Lloyd Algorithm (GLA) is used to generate a dw-dimensional wide-band V (UV) sound code book of a size sw from a dw-dimensional autocorrelation parameter of each of the wide-band frames.

It is checked from the encoding result to which code vector of the sound code book thus generated the autocorrelation parameter of each wide-band V (UV) frame is quantized. For each of the code vectors, dn-dimensional autocorrelation parameters corresponding to the wide-band V (UV) frames quantized to the vector, namely, obtained from each narrow-band V (UV) frame processed at the same time as the wide-band V (UV) frames, are weighted, for example, and taken as narrow-band code vectors at Step S8. This operation is done for all the code vectors to generate a narrow-band sound code book.

Figure 4:
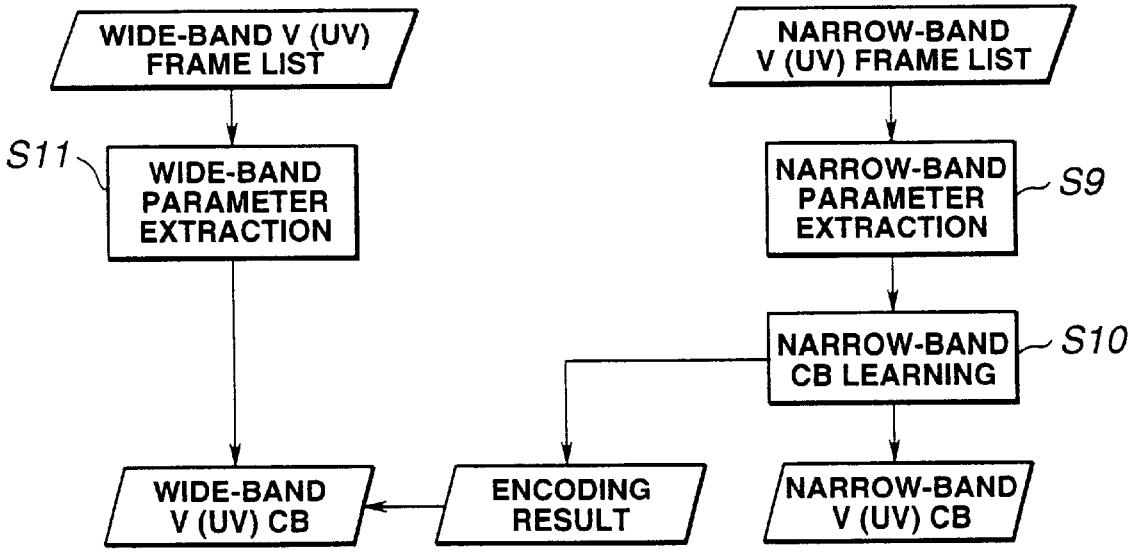
FIG. 4 is a flow chart of the generation of the sound code book used in the sound band expander in FIG. 1.

FIG. 4 is a flow chart of the generation of the sound code book, showing a method symmetrical with the aforementioned one. Namely, the narrow-band frame parameters are used for learning first at Steps 9 and 10, to generate a narrow-band sound code book. At Step 11, corresponding wide-band frame parameters are weighted.

As described in the foregoing, the four sound code books, namely, the narrow-band V and UV sound code books and wide-band V and UV sound code books.

The sound band expander having the aforementioned method sound band expansion applied therein will function to convert an actual input narrow-band sound using the above four sound code books to a narrow-band sound as will be described with reference to FIG. 5 being a flow chart of the operations of the sound band expander in FIG. 1.

First, the narrow-band sound signal received at the input terminal 1 of the sound band expander will be framed at every 160 samples (20 msec) by the framing circuit 2 at Step 21. Each of the frames from the framing circuit 2 is supplied to the LPC analyzer 3 and subjected to LPC analysis at Step S23. The frame is separated into a linear prediction factor parameter $\alpha$ and an LPC remainder. The parameter $\alpha$ is supplied to the $\alpha/\gamma$ converter 4 and converted to an autocorrelation $\gamma$ at Step S24.

Also, the framed signal is discriminated between V (voiced) and UV (unvoiced) sounds in the V/UV discriminator 5 at Step S22. As shown in FIG. 1, the sound band expander according to the present invention further comprises a switch 6 provided to connect the output of the $\alpha/\gamma$ converter 4 to the narrow-band V sound quantizer 7 or narrow-band UV sound quantizer 9 provided downstream of the $\alpha/\gamma$ converter 4. When the framed signal is judged to be V, the switch 6 connects the signal path to the narrow-band voiced sound quantizer 7. On the contrary, when the signal is judged to be UV, the switch 6 connects the output of the $\alpha/\gamma$ converter 4 to the narrow-band UV sound quantizer 9.

Note however that the V/UV discrimination effected at this Step S22 is different from that effected for the sound code book generation. Namely, there will result any frame belonging to neither V nor UV. In the V/UV discriminator 5, a frame signal will be judged to be either V or Uw without fail. Actually, however, a sound signal in a high band shows a large energy. An UV sound has a larger energy than a V sound. There is a tendency that a sound signal having a large energy is likely to be judged to be an UV signal. In this case, an abnormal sound will be generated. To avoid this, the V/UV discriminator is set to take as V a sound signal difficult to discriminate between V and UV.

When the V/UV discriminator 5 judges an input sound signal to be a V sound, the voiced sound autocorrelation g from the switch 6 is supplied to the narrow-band V sound quantizer 7 in which it is quantized using the narrow-band V sound code book 8 at Step S25. On the contrary, when the V/UV discriminator 5 judges the input sound signal to be an UV sound, the unvoiced sound autocorrelation γ from the switch 6 is supplied to the narrow-band UV quantizer 9 in which it is quantized using the narrow-band UV sound code book 10 at Step S25.

At Step S26, the wide-band V dequantizer 11 or wide-band UV dequantizer 13 dequantizes the quantized autocorrelation γ using the wide-band V sound code book 12 or wide-band UV sound code book 14, thus providing a wide-band autocorrelation γ.

At Step S27, the narrow-band autocorrelation γ is converted by the γ/α converter 15 to a wide-band autocorrelation α.

On the other hand, the LPC remainder from the LPC analyzer 3 is upsampled and aliased to have a wide band, by zerofilling between samples by the zerofilling circuit 16 at Step S28. It is supplied as a wide-band innovation to the LPC synthesizer 17.

At Step S29, the wide-band autocorrelation a and wide-band innovation are subjected to an LPC synthesis in the LPC synthesizer 17 to provide a wide-band sound signal.

However, the wide-band sound signal thus obtained is just the signal resulting from the prediction, and it contains a prediction error unless otherwise processed. In particular, an input narrow-band sound should preferably be left as it is without coping with its frequency range.

Therefore, at Step S30, the input narrow-band sound has the frequency range eliminated through filtering by the BSF (band stop filter) 18, and is added, at Step S31, to a narrow-band sound having been oversampled in the oversampling circuit 19 at Step S32. Thus, a wide-band sound signal having the band thereof expanded is provided. At the above addition, the gain can be adjusted and the high band is somehow suppressed to provide a sound having a higher quality for hearing.

The sound band expander in FIG. 1 uses the autocorrelation parameters to generate a total of 4 sound code books. However, any other parameter than the autocorrelation may be used. For example, LPC cepstrum will be effectively usable for this purpose, and a spectrum envelope may be used directly as parameter from the standpoint of spectrum envelope prediction.

Also, the sound band expander in FIG. 1 uses the narrow-band V (UV) sound code books 8 and 10. However, they may be omitted for the purpose of reducing the capacity of RAM capacity for the sound code books.

Figure 6:
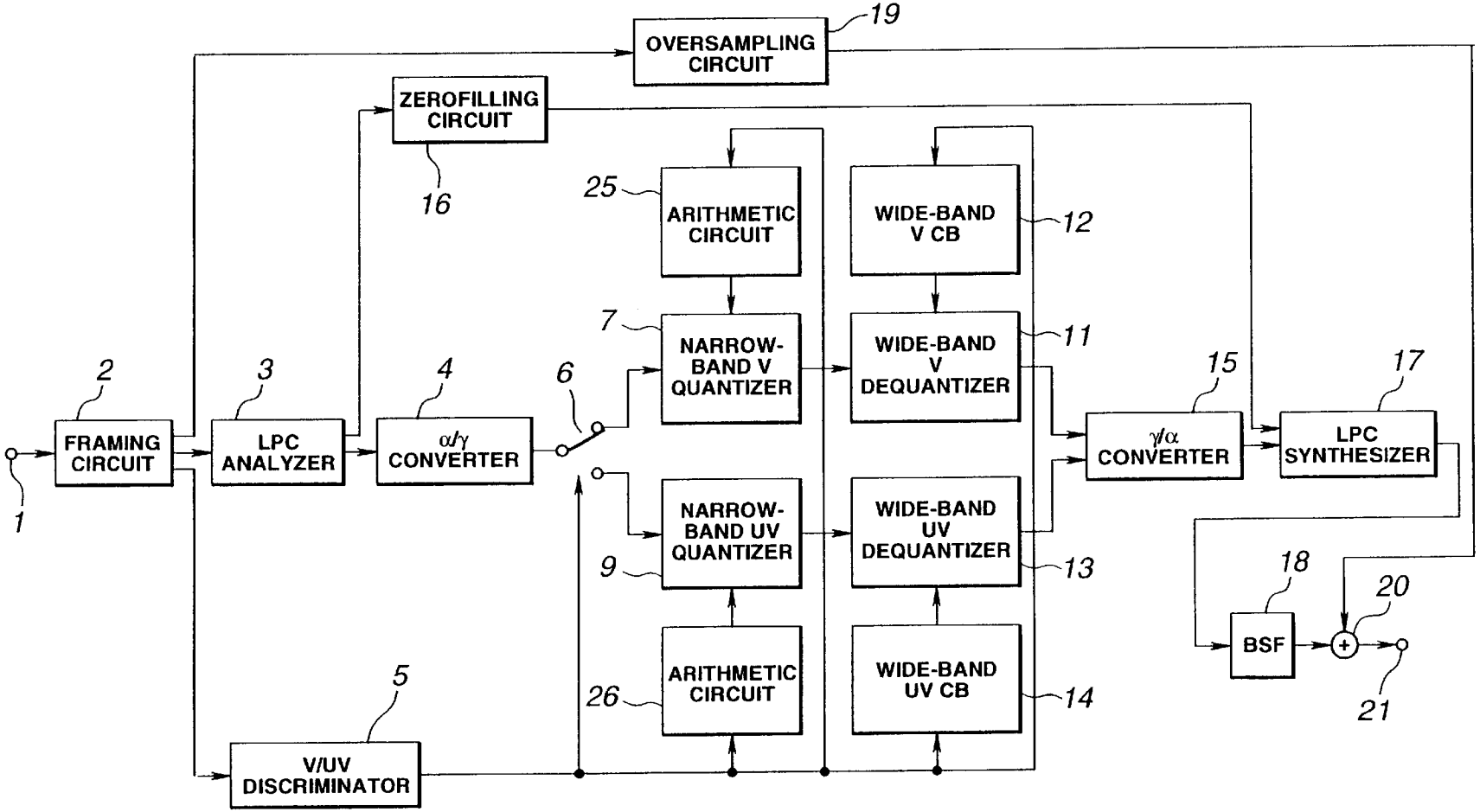
FIG. 6 is a block diagram of a variant of the sound band expander in FIG. 1 in which a reduced number of the sound code books is used.

FIG. 6 is a block diagram of a variant of the sound band expander in FIG. 1 in which a reduced number of the sound code books is used. The sound band expander in FIG. 6 employs an arithmetic circuits 25 and 26 in place of the narrow-band V and UV sound code books 8 and 10. The arithmetic circuits 25 and 26 are provided to obtain narrow-band V and UV parameters, by calculation, from code vectors in the wide-band sound code books. The rest of this sound band expander is configured similarly to that shown in FIG. 1.

When an autocorrelation is used as parameter in the sound code book, there is a relation expressed below between the wide- and narrow-band sound autocorrelations.

$$\phi(x_n)=\phi(x_w \otimes h)=\phi(x_w)\otimes\phi(h) \tag{2}$$

where $f$ is an autocorrelation, $x_n$ is a narrow-band sound signal, $x_w$ is a wide-band sound signal and h is an impulse response of the band stop filter.

A narrow-band autocorrelation $f(x_n)$ can be calculated from a wide-band autocorrelation $f(x_w)$ based on the above relation, so it is theoretically unnecessary to have both wide- and narrow-band vectors.

That is to say, the narrow-band autocorrelation can be determined by convolution of the wide-band autocorrelation and an autocorrelation of the impulse response of a band stop filter.

Figure 5:
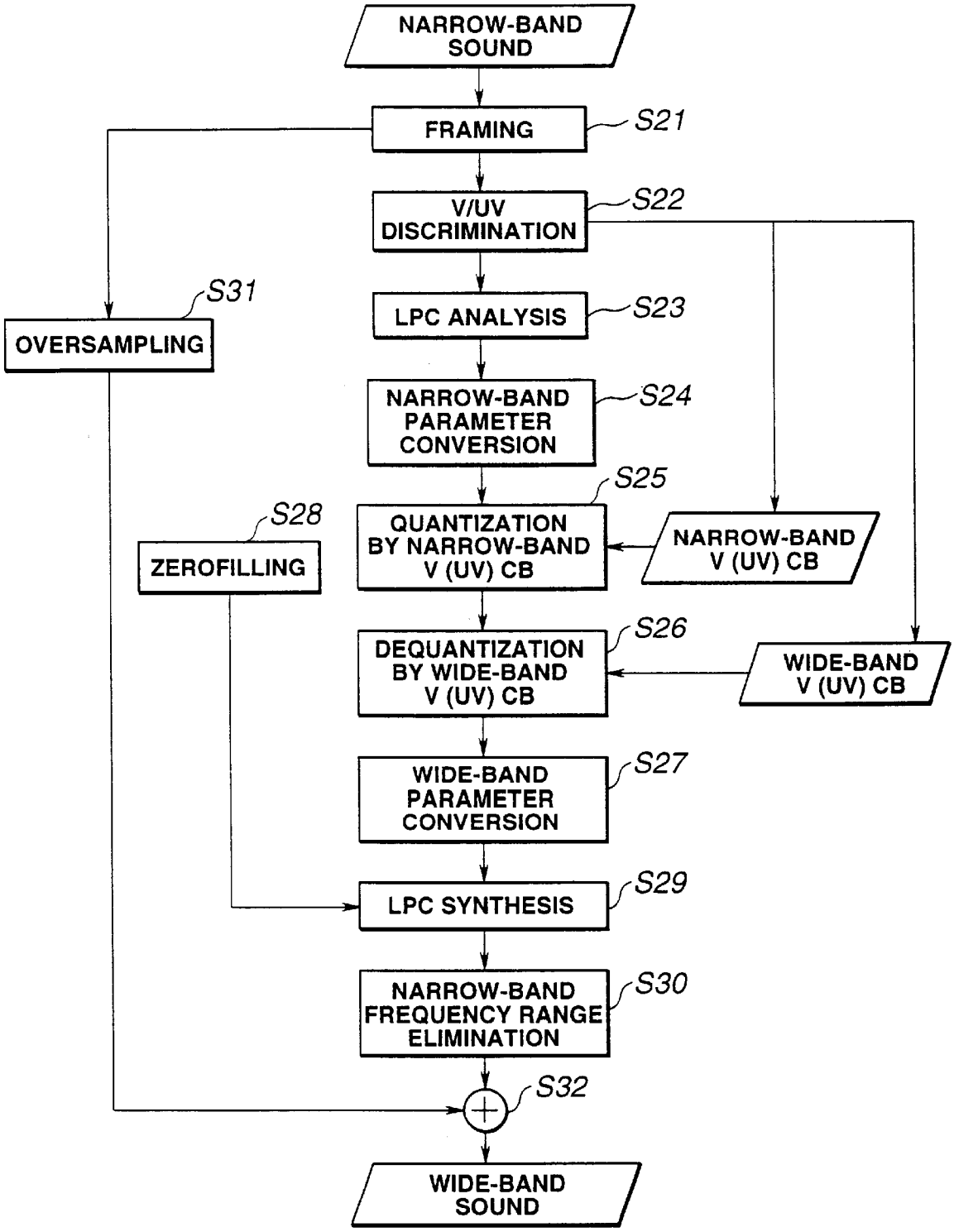
FIG. 5 is a flow chart of the operations of the sound band expander in FIG. 1.
Figure 7:
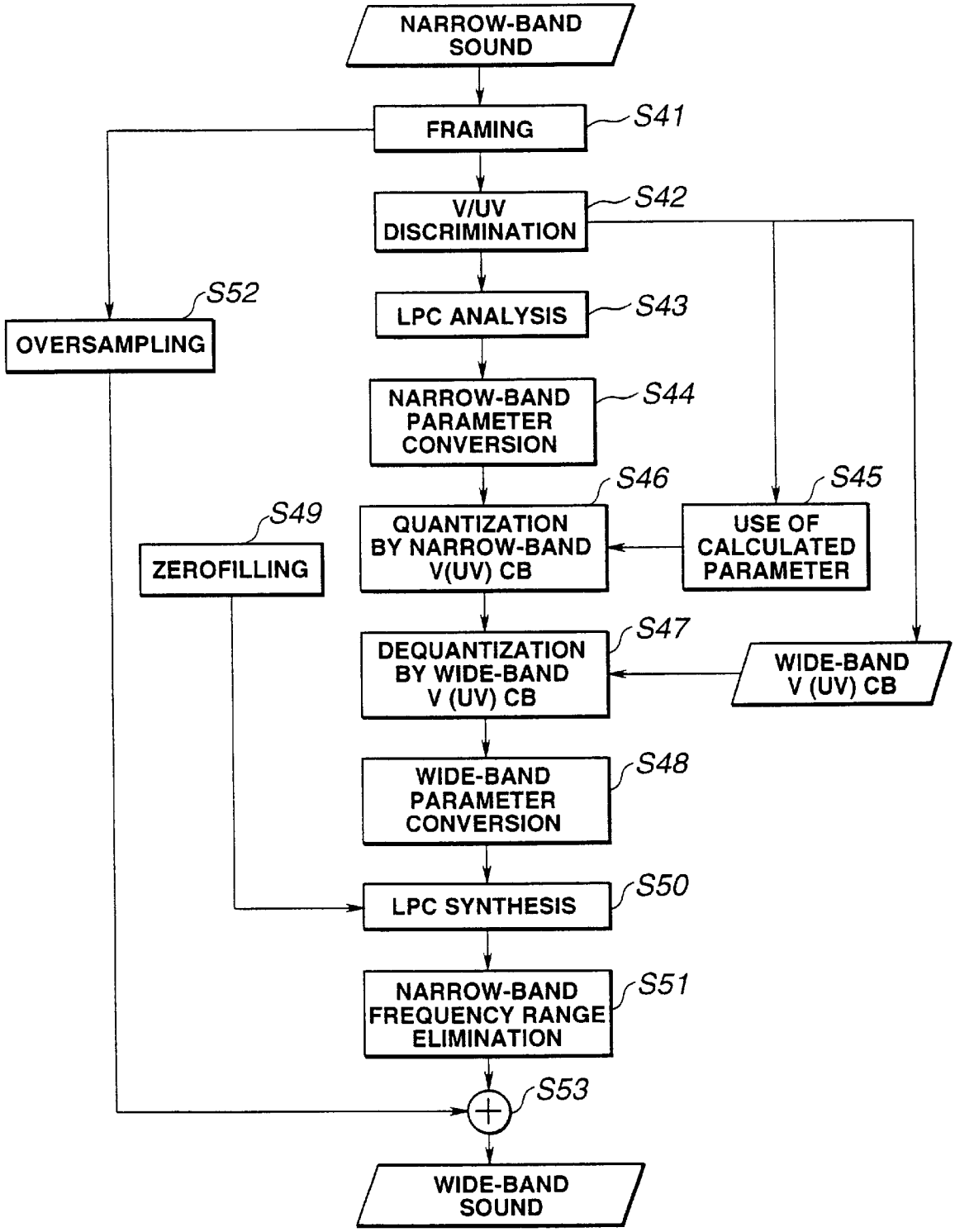
FIG. 7 is a flow chart of the operations of the variant of the sound band expander in FIG. 6.

Therefore, the sound band expander in FIG. 6 can effect a band expansion not as shown in FIG. 5, but as in FIG. 7 being a flow chart of the operations of the variant of the sound band expander in FIG. 6. More particularly, the narrow-band sound signal received at the input terminal 1 is framed at every 160 samples (20 msec) in the framing circuit 2 at Step S41 and supplied to the LPC analyzer 3 in which each of the frames is subjected to LPC analysis at Step S43 and separated into a linear prediction factor parameter a and LPC remainder. The parameter a is supplied to the α/γ converter 4 in which it is converted to an autocorrelation γ at Step S44.

Also, the framed signal is discriminated between V (voiced) and UV (unvoiced) sounds in the V/UV discriminator 5 at Step S42. When the framed signal is judged to be V, the switch 6 connects the signal path from the α/γ converter 4 to the narrow-band voiced sound quantizer 7. On the contrary, when the signal is judged to be UV, the switch 6 connects the output of the α/γ converter 4 to the narrow-band UV sound quantizer 9.

The V/UV discrimination effected at this Step S42 is different from that effected for the sound code book generation. Namely, there will result any frame belonging to neither V nor UV. In the V/UV discriminator 5, a frame signal will be discriminated between V and UV without fail.

When the V/UV discriminator 5 judges an input sound signal to be a V sound, the voiced sound autocorrelation γ from the switch 6 is supplied to the narrow-band V sound quantizer 7 in which it is quantized at Step S46. In this quantization, however, no narrow-band sound code book is used but the narrow-band V parameter determined by the arithmetic circuit 25 at Step S45 as having previously been described is used.

On the contrary, when the V/UV discriminator 5 judges the input sound signal to be an UV sound, the unvoiced sound autocorrelation γ from the switch 6 is supplied to the narrow-band UV quantizer 9 in which it is quantized at Step S46. Also at this time, however, no narrow-band UV sound code book is used but the narrow-band UV parameter determined by calculation at the arithmetic circuit 26 is used.

At Step S47, the wide-band V dequantizer 11 or wide-band UV dequantizer 13 dequantizes the quantized autocorrelation γ using the wide-band V sound code book 12 or wide-band UV sound code book 14, thus providing a wide-band autocorrelation γ.

At Step S48, the narrow-band autocorrelation γ is converted by the γ/α converter 15 to a wide-band autocorrelation α.

On the other hand, the LPC remainder from the LPC analyzer 3 is zerofilled between samples at the zerofilling circuit 16 and thus upsampled and aliased to have a wide band, at Step S49. It is supplied as a wide-band innovation to the LPC synthesizer 17.

At Step S50, the wide-band autocorrelation a and wide-band innovation are subjected to an LPC synthesis in the LPC synthesizer 17 to provide a wide-band sound signal.

However, the wide-band sound signal thus obtained is just the signal resulting from the prediction, and it contains a prediction error unless otherwise processed. In particular, an input narrow-band sound should preferably be left as it is without coping with its frequency range.

Therefore, at Step S51, the input narrow-band sound has the frequency range eliminated through filtering by the BSF (band stop filter) 18, and is added, at Step S53, to a narrow-band sound having been oversampled in the oversampling circuit 19 at Step S52.

Thus, in the sound band expander in FIG. 6, the quantization is not effected by comparison with code vectors in the narrow-band sound code books, but by comparison with code vectors determined, by calculation, from the wide-band sound code books. Therefore, the wide-band sound code books are used for both the sound signal analysis and synthesis, so the memory for storage of the narrow-band sound code books is unnecessary for the sound band expander in FIG. 6.

Figure 8:
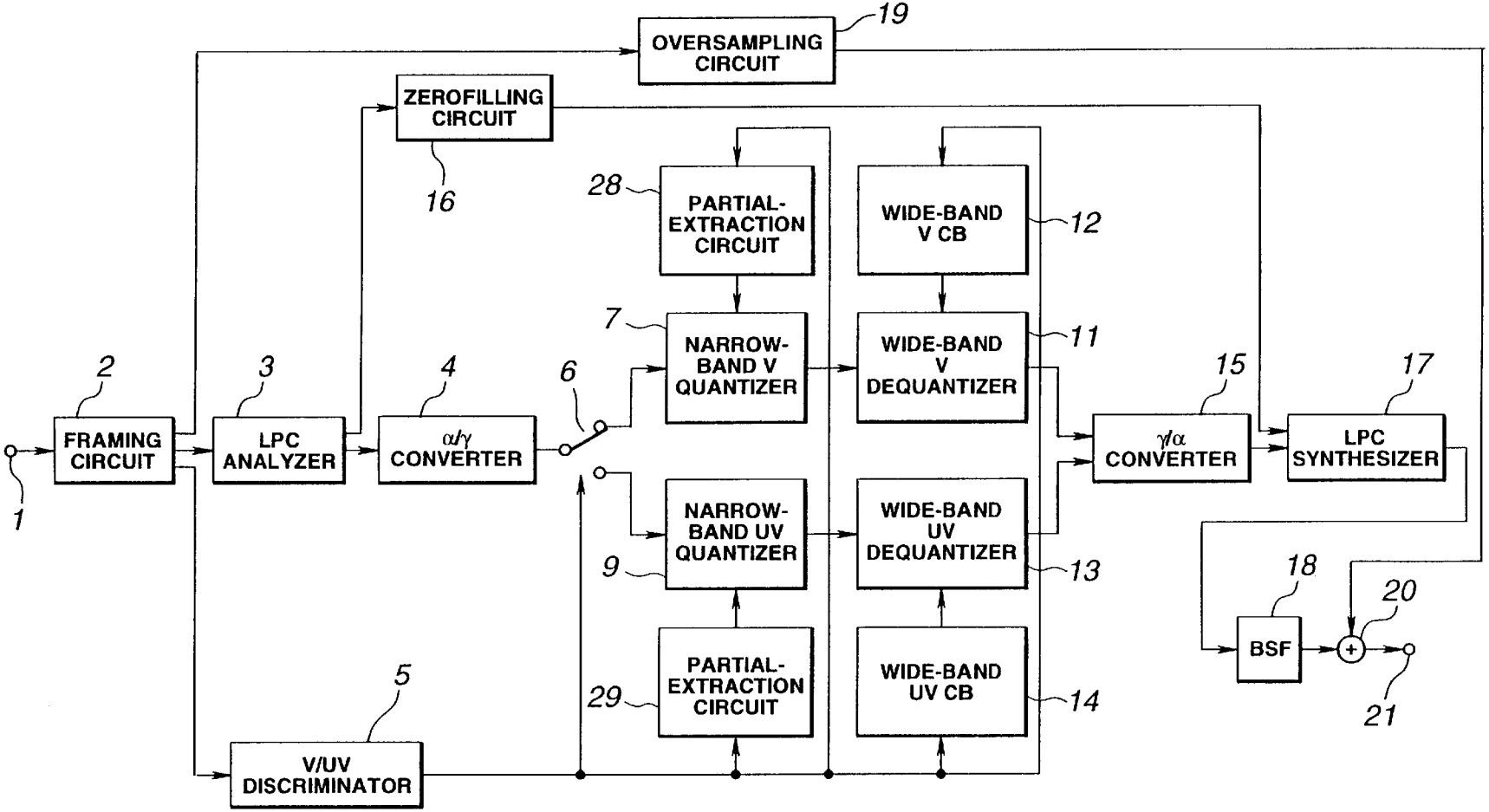
FIG. 8 is a block diagram of another variant of the sound band expander in FIG. 1 in which a reduced number of the sound code books is used.

In the sound band expander shown in FIG. 6, however, the addition of the calculation to the operations for the sound band expansion rather than the effect resulted from the saving of the memory capacity may possibly be a problem. To avoid this problem, the present invention also provides a variant of the sound band expander in FIG. 6 in which a sound band expanding method with no addition of the operations is applied. FIG. 8 shows the variant of the sound band expander. As shown in FIG. 8, the sound band expander employs partial-extraction circuits 28 and 29 to partially extract each of the code vectors in the wide-band sound code books, in place of the arithmetic circuits 25 and 26 used in the sound band expander shown in FIG. 6. The rest of this sound band expander is configured similarly to that shown in FIG. 1 or FIG. 6.

The autocorrelation of the impulse response of the aforementioned band stop filter (BSF) 18 is a power spectrum of the band stop filter in the frequency domain as represented by the following relation (3).

$$\phi(h)=F^{-1}(|H|^2) \tag{3}$$

where H is a frequency characteristic of the BSF 18.

Assume here another filter having a frequency characteristic equal to the power characteristic of the existing BSF 18 and the frequency characteristic is H'. Then the relation (3) can be expressed as follows:

$$\phi(h)=F^{-1}(|H|^2)=F^{-1}(H')=h' \tag{4}$$

The new filter has a pass and inhibition zones represented by the relation (4), equivalent to those of the existing BSF 18, and an attenuation characteristic being a square of that of the BSF 18. Therefore, the new filter may be said to be a band stop filter.

Taking the above in consideration, the narrow-band autocoffelation is simplified as represented by the following relation (5) resulted from convolution of the wide-band autocorrelation and impulse response of the band stop filter, namely, from band stop of the wide-band autocorrelation:

$$\phi(x_n)=\phi(x_n)h' \tag{5}$$

When the parameter used as the sound code book is an autocorrelation, the autocorrelation parameter in the actual voiced sound (V) has a tendency that it depicts a gentle descending curve, namely, the first-order autocorrelation parameter is larger than the second-order one, the second-order one is larger than the third-order one, . . .

On the other hand, the relation between a narrow-band sound signal and a wide-band sound signal is such that the wide-band sound signal is low-passed to provide the narrow-band sound signal. Therefore, a narrow-band autocorrelation can theoretically be determined by low-passing a wide-band autocorrelation.

However, since the wide-band autocorrelation varies gently, it shows little change even if low-passed. Therefore, the low-passing may be omitted with no adverse affect. Namely, the wide-band autocorrelation may be used as a narrow-band autocorrelation. Since the sampling frequency of a wide-band sound signal is set to be double that of a narrow-band sound signal, however, the narrow-band autocorrelation is taken at every other sample in practice.

That is to say, wide-band autocorrelation code vectors taken at every other sample can be dealt with equivalently to a narrow-band autocorrelation code vector. An autocorrelation of an input narrow-band sound can be quantized using the wide-band sound code books, thus the narrow-band sound code books will be unnecessitated.

As previously mentioned, an UV sound has a larger energy than a V sound and an error prediction will have a large influence. To avoid this, the V/UV discriminator is set to take as V a sound signal difficult to discriminate between V and UV. Namely, a sound signal is judged to be UV only when the sound signal is highly probable to be UV. For this reason, the UV sound code book is smaller in size than the V sound code book in order to register only such code vectors different from each other. Therefore, although the autocorrelation of UV does not show a curve so gentle as that of V comparison of a wide-band autocorrelation code vector taken at every other orders with an autocorrelation of an input narrow-band signal makes it possible to attain an equal quantization of a narrow-band input sound signal to that of a low-passed wide-band autocorrelation code vector, namely, to a quantization when a narrow-band sound code book is available. That is, both V and UV sounds can be quantized with no narrow-band sound code books.

As having been described in the foregoing, when an autocorrelation is taken as a parameter used in the sound code book, an autocorrelation of an input narrow-band sound can be quantized by comparison with a wide-band code vector taken at every other orders. This operation can be realized by allowing the partial-extraction circuits 28 and 29 to take code vectors of a wide-band sound code book at every other orders at Step S45 in FIG. 7.

Now, a quantization using a spectrum envelope as parameter in the sound code book will be described herebelow. in this case, since a narrow-band spectrum is a part of a wide-band spectrum, no narrow-band spectrum sound code book is required for the quantization. Needless to say, the spectrum envelope of an input narrow-band sound can be quantized though comparison with a part of a wide-band spectrum envelope code vector.

Figure 9:
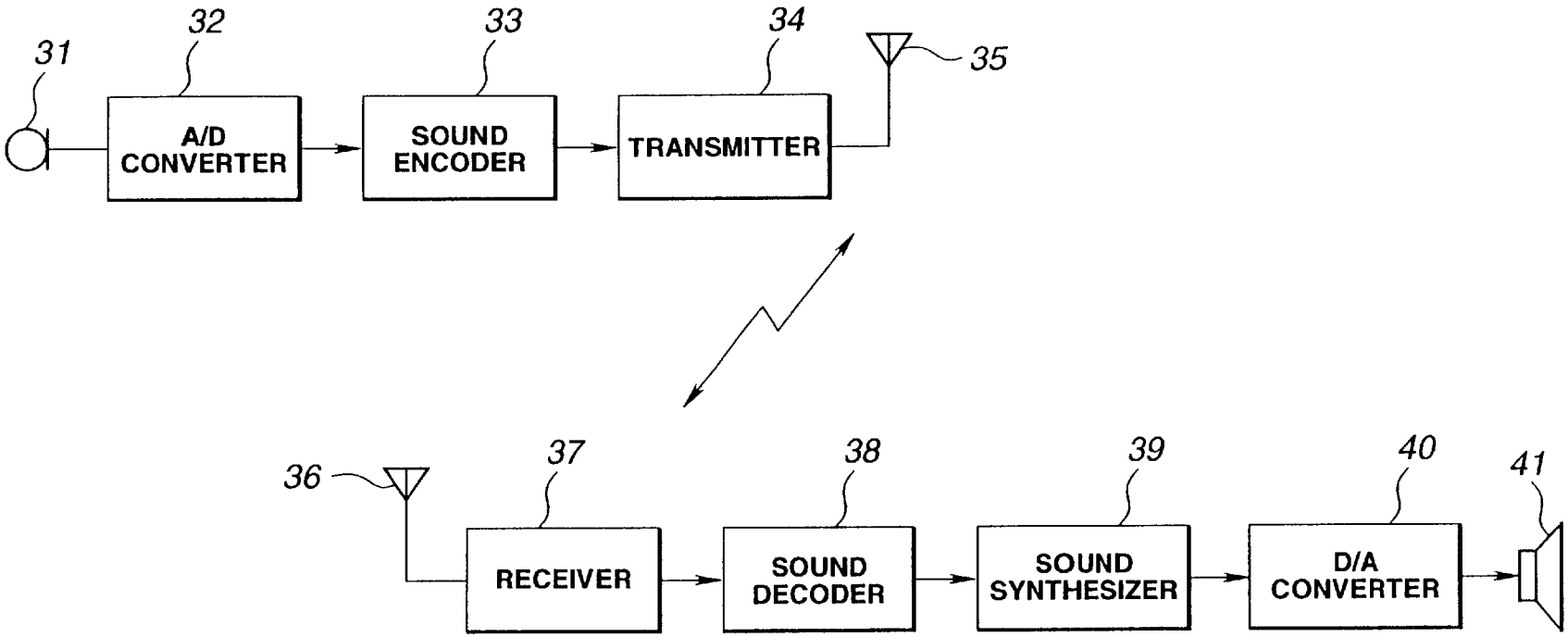
FIG. 9 is a block diagram of a digital portable or pocket telephone having applied in the receiver thereof the sound synthesizer of the present invention.

Next, the sound synthesizing method and apparatus according to the present invention will be described with reference to FIG. 9 being a block diagram of a digital portable or pocket telephone having applied in the receiver thereof an embodiment of the sound synthesizer of the present invention. This embodiment comprises wide-band sound code books pre-formed from characteristic parameters extracted at each predetermined time unit from a wide-band sound and is adapted to synthesize a sound using plural kinds of input coded parameters. The sound synthesizer at the receiver side of a portable digital telephone system shown in FIG. 9 comprises a sound decoder 38 and a sound synthesizer 39.

The portable digital telephone is configured as will be described below. Of course, both a transmitter and receiver are incorporated together in a portable telephone set in practice, but they will be separately described for the convenience of explanation.

At the transmitter side of the digital portable telephone system, a sound signal supplied as an input through a microphone 31 is converted to a digital signal by an AID converter 32, encoded by a sound encoder 33, and then processed to output bits by a transmitter 34 which transmits it from an antenna 35

The sound encoder 33 supplies the transmitter 34 with a coded parameter involving a consideration given to a transmission path-limited conversion to a narrow-band signal. The coded parameters include, for example, innovation-related parameter, linear prediction factor α, etc.

At the receiver side, a wave captured by an antenna 36 is detected by a receiver 37, the coded parameters carried by the wave are decoded by the sound decoder 38, a sound is synthesized using the coded parameters by the sound synthesizer 39, the synthesized sound is converted to an analog sound signal by a D/A converter 40 and delivered at a speaker 41.

Figure 10:
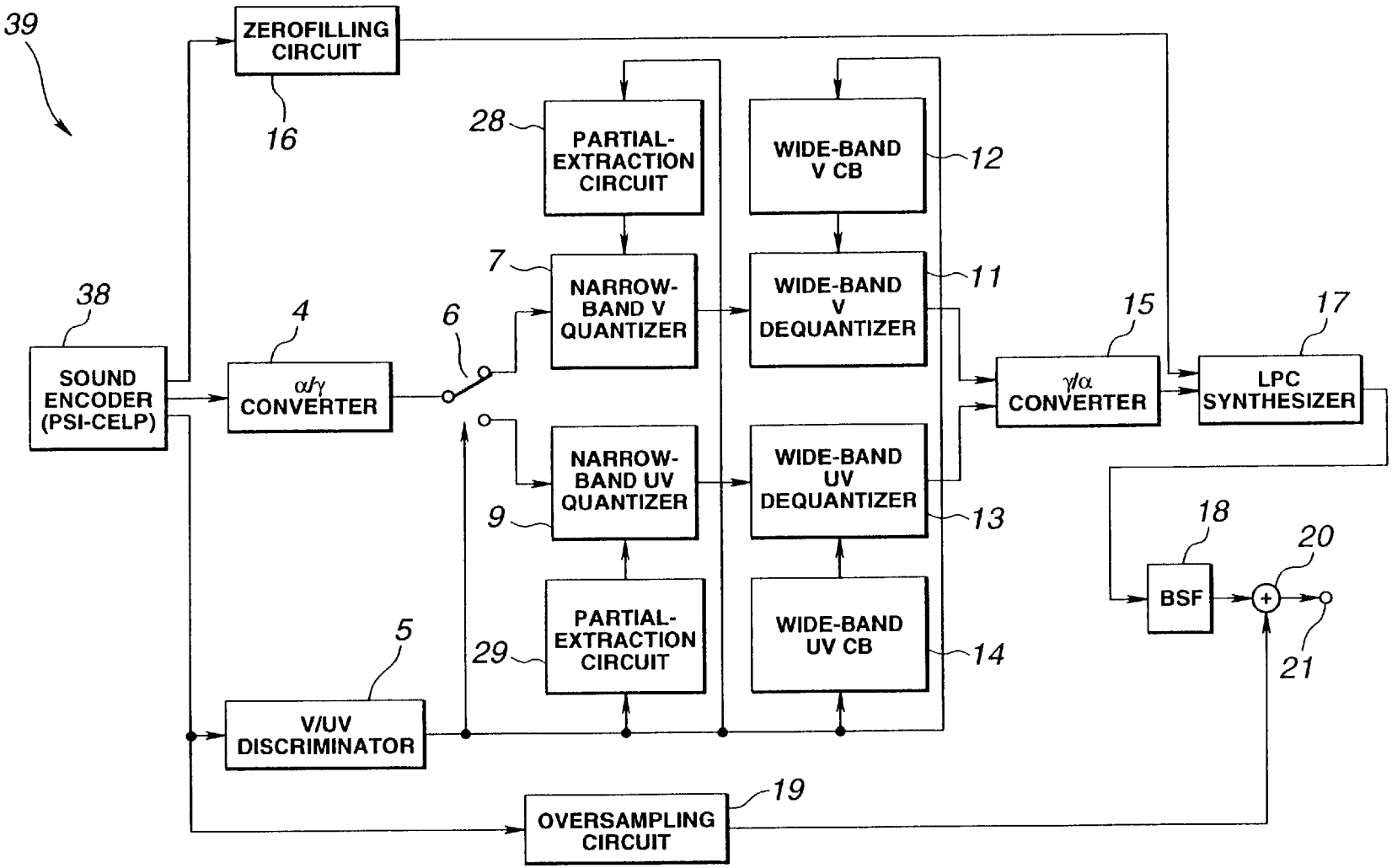
FIG. 10 is a block diagram of the sound synthesizer of the present invention employing the PSI-CELP encoding mode in the sound decoder thereof.

FIG. 10 is a block diagram of a first embodiment of the sound synthesizer of the present invention used in the digital portable telephone set. The sound synthesizer shown in FIG. 10 is destined to synthesize a sound using coded parameters sent from the sound encoder 33 at the transmitter side of the digital portable telephone system, and thus the sound decoder 38 at the receiver side decodes the encoded sound signal in the mode in which the sound has been encoded by the sound encoder 33 at the transmitter side.

Namely, when the sound signal encoding is done by the sound encoder 33 in the PSI-CELP (Pitch Synchronous Innovation-Code Excited Linear Prediction) mode, the sound decoder 38 adopts the PSI-CELP mode to decode the encoded sound signal from the transmitter side.

The sound decoder 38 decodes an innovation-related parameter being a first one of the coded parameters to a narrow-band innovation, and then supplies it to the zerofilling circuit 16. Also it converts a linear prediction factor a being a second one of the coded parameters to the α/γ converter 4 (α=linear prediction factor; γ=autocorrelation). Further it supplies a V/UV discriminator 5 with a voiced/unvoiced sound flag-related signal being a third one of the coded parameters.

The sound synthesizer also comprises a wide-band voiced sound code book 12 and wide-band unvoiced sound code book 14, pre-formed using voiced and unvoiced sound parameters extracted from wide-band and unvoiced sounds, in addition to the sound decoder 38, zerofilling circuit 16, α/γ converter 4 and the V/UV discriminator 5.

As shown in FIG. 10, the sound synthesizer further comprises partial-extraction circuits 28 and 29 to determine narrow-band parameters through partial extraction of each code vector in the wide-band voiced sound code book 12 and wide-band unvoiced sound code book 14, a narrow-band voiced sound quantizer 7 to quantize a narrow-band voiced sound autocorrelation from the α/γ converter 4 using the narrow-band parameter from the partial-extraction circuit 28, a narrow-band unvoiced sound quantizer 9 to quantize the narrow-band unvoiced sound autocorrelation from the α/γ converter 4 using the narrow-band parameter from the partial-extraction circuit 29, a wide-band voiced sound dequantizer 11 to dequantize the narrow-band voiced sound quantized data from the narrow-band voiced sound quantizer 7 using the wide-band voiced sound code book 12, a wide-band unvoiced sound dequantizer 13 to dequantize the narrow-band unvoiced quantized data from the narrow-band unvoiced sound quantizer 9 using the wide-band unvoiced sound code book 14, a γ/α converter 15 to convert the wide-band voiced sound autocorrelation (a dequantized data) from the narrow-band voiced sound dequantizer 11 to a narrow-band voiced sound linear prediction factor, and the wide-band unvoiced sound autocorrelation (a dequantized data) from the wide-band unvoiced sound dequantizer 13 to a narrow-band unvoiced sound linear prediction factor, and an LPC synthesizer 17 to synthesize a wide-band sound based on the narrow-band voiced and unvoiced sound linear prediction factors from the γ/α converter 15 and the innovation from the zerofilling circuit 16.

The sound synthesizer further comprises an oversampling circuit 19 provided to change the sampling frequency of the narrow-band sound data decoded by the sound decoder 38 from 8 kHz to 16 kHz, a band stop filter (BSF) 18 to eliminate or remove a signal component of 300 to 3,400 Hz in frequency band of the input narrow-band voiced sound signal from a synthesized output from the LPC synthesizer 17, and an adder 20 to add to an output from the BSF filter 18 the signal component of 300 to 3,400 Hz in frequency band and 16 kHz in sampling frequency of the original narrow-band voiced sound signal from the oversampling circuit 19.

The wide-band voiced and unvoiced sound code books 12 and 14 can be formed following the procedures shown in FIGS. 2 to 4. For a higher-quality sound code book, a component in transition from a voiced sound (V) to unvoiced sound (UV) or vice versa, and a one difficult to discriminate between V and UV, are eliminated to provide only sounds being surely V and UV. Thus, a collection of learning narrow-band V frames and a collection of learning narrow-band UV frames are obtained.

Figure 11:
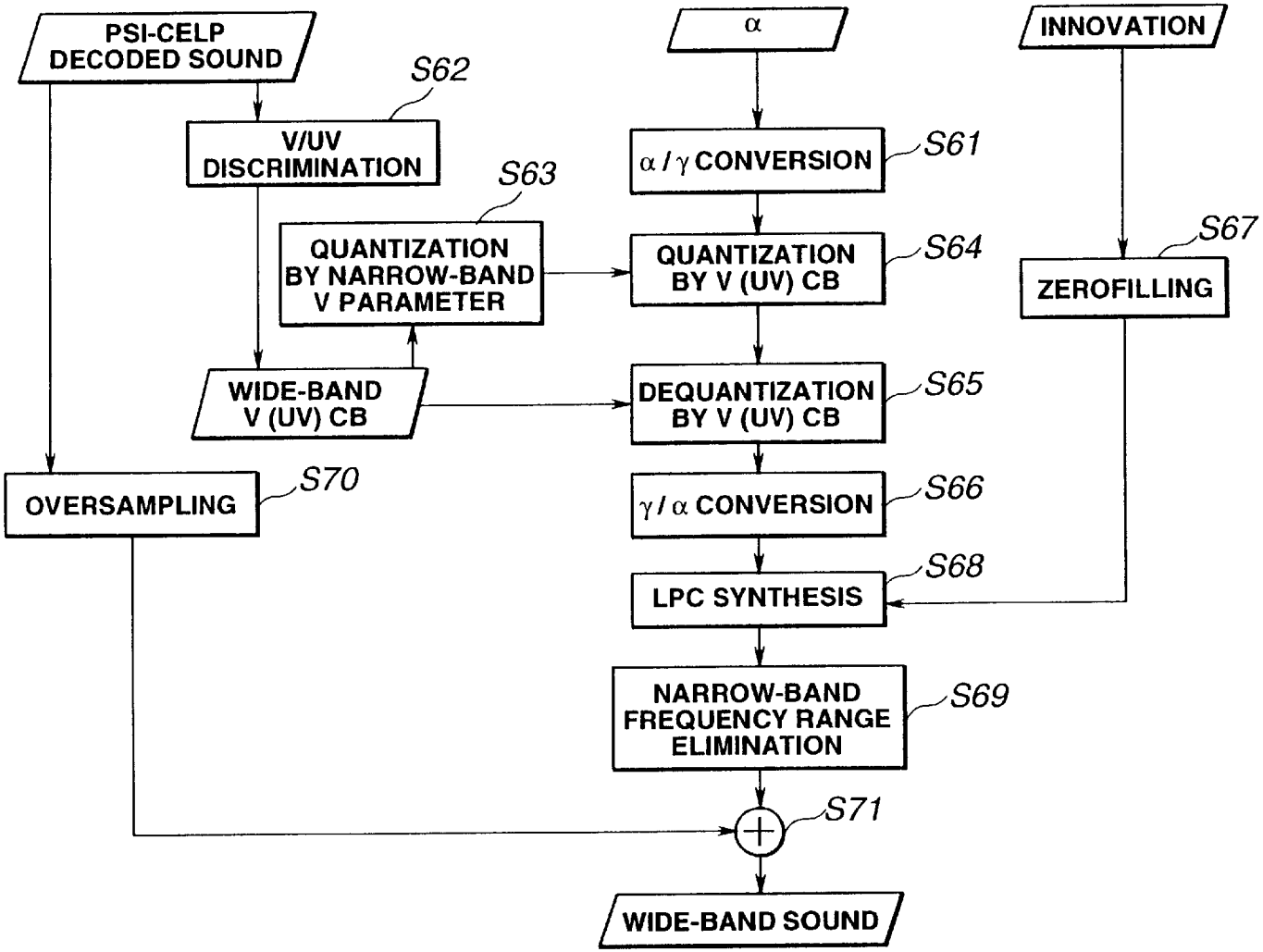
FIG. 11 is a flow chart of the operations of the sound synthesizer in FIG. 10.

A sound synthesis using the wide-band voiced and unvoiced sound code books 12 and 14 as well as actual coded parameters transmitted from the transmitter side will be described with reference to FIG. 11, a flow chart of the operations of the sound synthesizer in FIG. 10.

First, a linear prediction factor a decoded γ the sound decoder 38 is converted to an autocorrelation γ by the α/γ converter 4 at Step S61.

Also, the voiced/unvoiced (V/UV) sound discrimination flag-related parameter is decoded by the sound decoder 38 are discriminated between V (voiced) and UV (unvoiced) sounds in the V/UV discriminator 5 at Step S62.

When the framed signal is judged to be V, the switch 6 connects the signal path to the narrow-band voiced sound quantizer 7. On the contrary, when the signal is judged to be UV, the switch 6 connects the output of the α/γ converter 4 to the narrow-band UV sound quantizer 9.

Note however that the V/UV discrimination effected at this Step S22 is different from that effected for the sound code book generation. Namely, there will result any frame belonging to neither V nor UV. In the V/UV discriminator 5, a frame signal will be judged to be either V or UV without fail.

When the V/UV discriminator 5 judges an input sound signal to be a V sound, the voiced sound autocorrelation γ from the switch 6 is supplied to the narrow-band V sound quantizer 7 in which it is quantized, at Step S64, using the narrow-band V sound parameter determined by the partial-extraction circuit 28 at Step S63, not using the narrow-band sound code book.

On the contrary, when the V/UV discriminator 5 judges the input sound signal to be an UV sound, the unvoiced sound autocorrelation g from the switch 6 is supplied to the narrow-band UV quantizer 9 in which it is quantized at Step S63 by using the narrow-band UV parameter determined by calculation in the partial-extraction circuit 29, not using the narrow-band UV sound code book.

At Step S65, the wide-band V dequantizer 11 or wide-band UV dequantizer 13 dequantizes the quantized autocorrelation using the wide-band V sound code book 12 or wide-band UV sound code book 14, respectively, thus providing a wide-band autocorrelation.

At Step S66, the wide-band autocorrelation γ is converted by the γ/α converter 15 to a wide-band autocorrelation α.

On the other hand, the innovation-relevant parameter from the sound decoder 38 is upsampled and aliased to have a wide band, by zerofilling between samples by the zerofilling circuit 16 at Step S67. It is supplied as a wide-band innovation to the LPC synthesizer 17.

At Step S68, the wide-band autocorrelation a and wide-band innovation are subjected to an LPC synthesis in the LPC synthesizer 17 to provide a wide-band sound signal.

However, the wide-band sound signal thus obtained is just a one resulted from the prediction, and it contains a prediction error unless otherwise processed. In particular, an input narrow-band sound should preferably be left as it is without coping with its frequency range.

Therefore, at Step S69, the input narrow-band sound has the frequency range eliminated through filtering by the BSF (band stop filter) 18, and is added, at Step S70, to an encoded sound data having been oversampled by the oversampling circuit 19 at Step S71.

Thus, the sound synthesizer in FIG. 10 is adapted to quantize by comparison with a code vectors determined by partial extraction from the wide-band sound code book, not by comparison with a code vector in any narrow-band sound code book.

Namely, since the parameter a is obtained in the course of decoding, it is converted to a narrow-band autocorrelation γ. The narrow-band autocorrelation γ is quantized by comparison with each vector, taken at every other orders, in the wide-band sound code book. Then, the quantized narrow-band autocorrelation is dequantized using all the vectors to provide a wide-band autocorrelation. This wide-band correlation is converted to a wide-band linear prediction factor a. The gain control and some suppression of the high band are effected as having previously been described to improve the quality for hearing.

Therefore, the wide-band sound code books are used for both the sound signal analysis and synthesis, so the memory for storage of the narrow-band sound code books is unnecessary.

Figure 12:
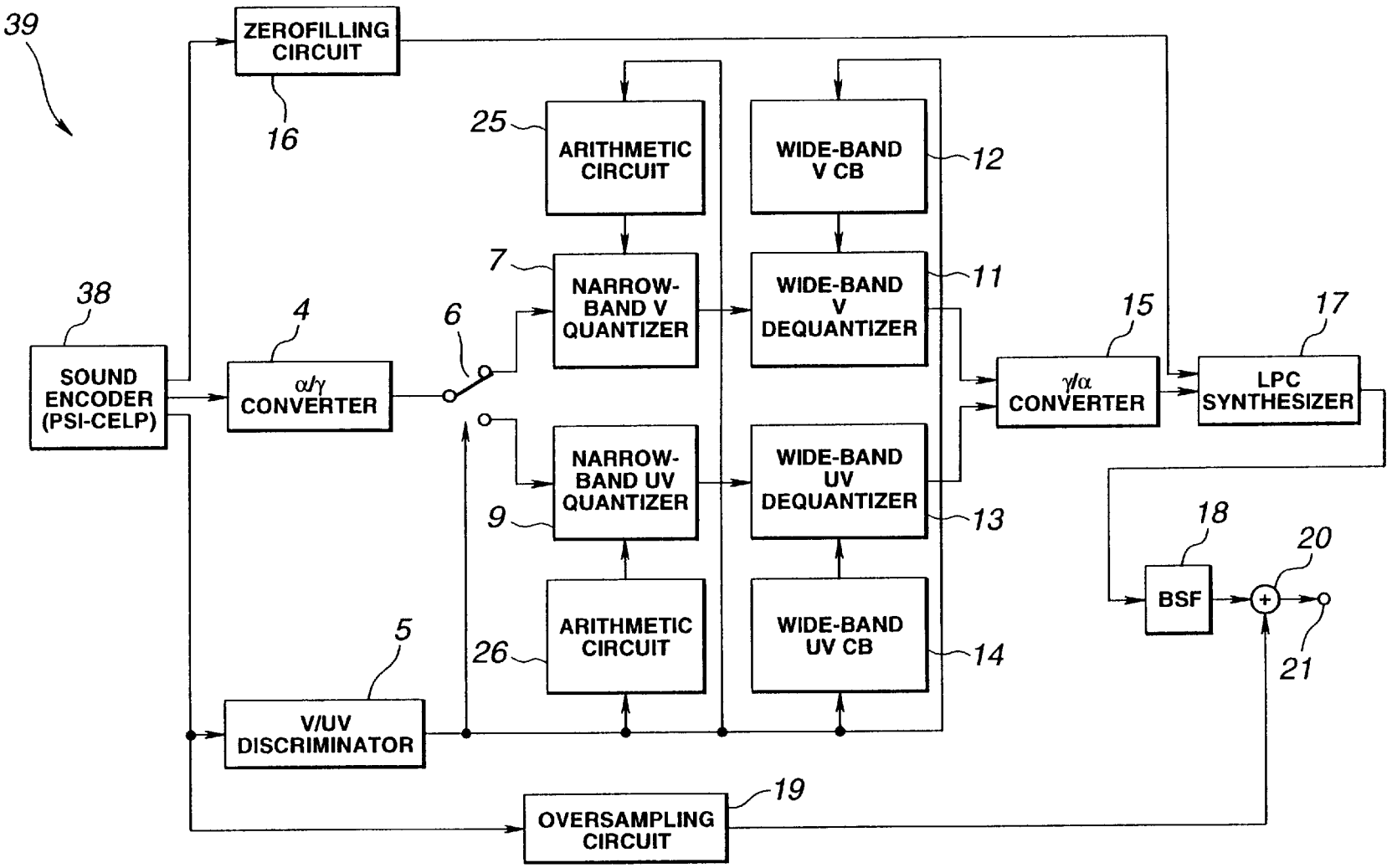
FIG. 12 is a block diagram of a variant of the sound synthesizer in FIG. 10 adopting the PSI-CELP encoding mode in the sound decoder thereof.

FIG. 12 is a block diagram of a possible variant of the sound synthesizer in FIG. 10, in which coded parameters from a sound decoder 38 adopting the PSI-CELP encoding mode is applied. The sound synthesizer shown in FIG. 12 uses arithmetic circuits 28 and 29 to provide narrow-band V (UV) parameters by calculation of each code vector in the wide-band sound code books, in place of the partial-extraction circuits 18 and 19. The rest of this sound synthesizer is configured similarly to that shown in FIG. 10.

Figure 13:
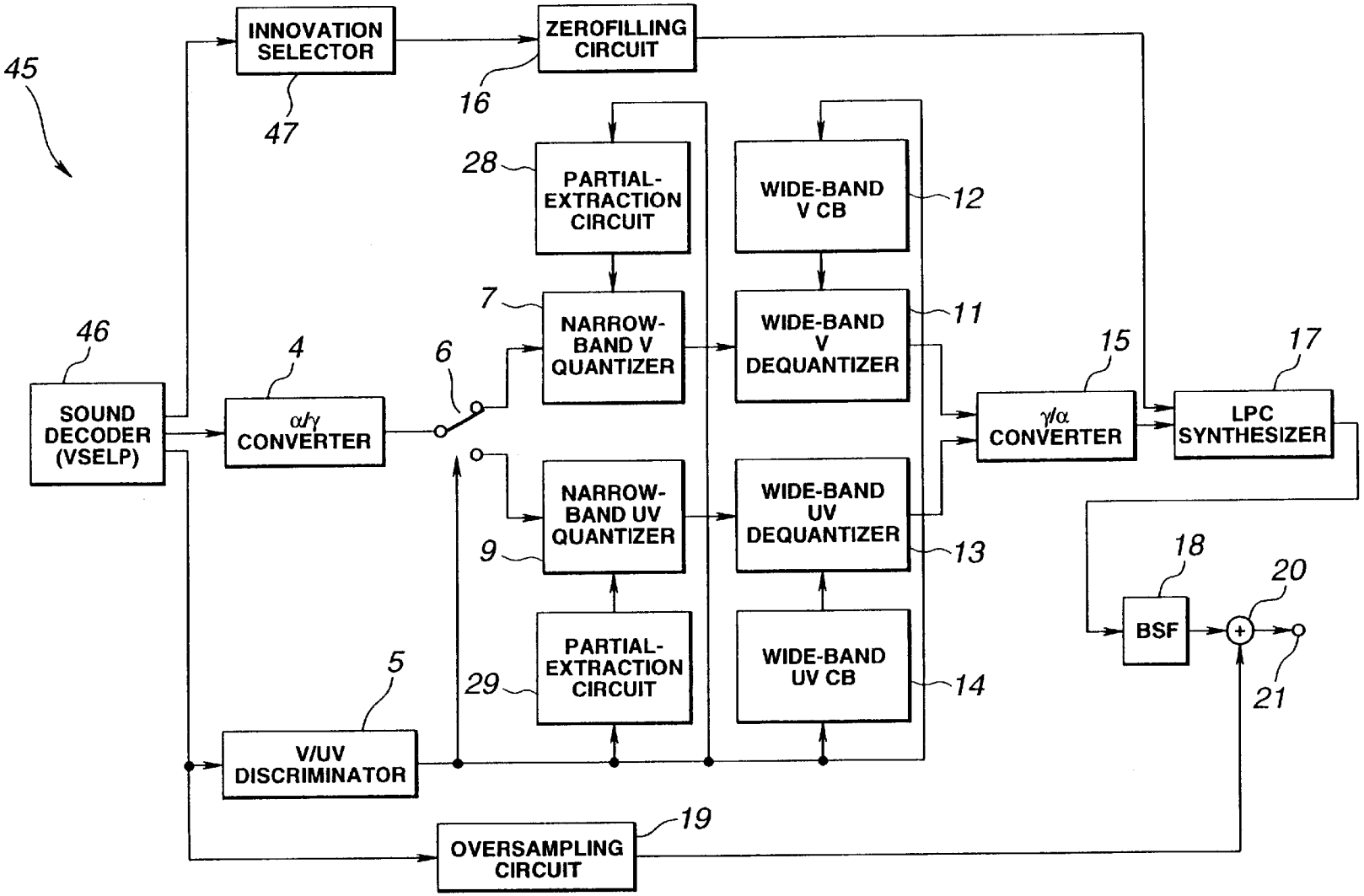
FIG. 13 is a block diagram of the sound synthesizer of the present invention employing the VSELP mode in the sound decoder thereof.

FIG. 13 is a block diagram of a second embodiment of the sound synthesizer of the present invention used in the digital portable telephone set. The sound synthesizer shown in FIG. 13 is destined to synthesize a sound using coded parameters sent from the sound encoder 33 at the transmitter side of the digital portable telephone system, and thus a sound decoder 46 in the sound synthesizer at the receiver side decodes the encoded sound signal in the mode in which the sound has been encoded by the sound encoder 33 at the transmitter side.

Namely, when the sound signal encoding is done by the sound encoder 33 in the VSELP (Vector Sum Excited Linear Prediction) mode, the sound decoder 46 adopts the VSELP mode to decode the encoded sound signal from the transmitter side.

The sound decoder 46 supplies to an innovation selector 47 an innovation-related parameter being a first one of the coded parameters. Also it supplies a linear prediction factor a being a second one of the coded parameters to the α/γ converter 4 (α=linear prediction factor; γ=autocorrelation). Further it supplies a V/UV discriminator 5 with a voiced/unvoiced sound flag-related signal being a third one of the coded parameters.

Figure 14:
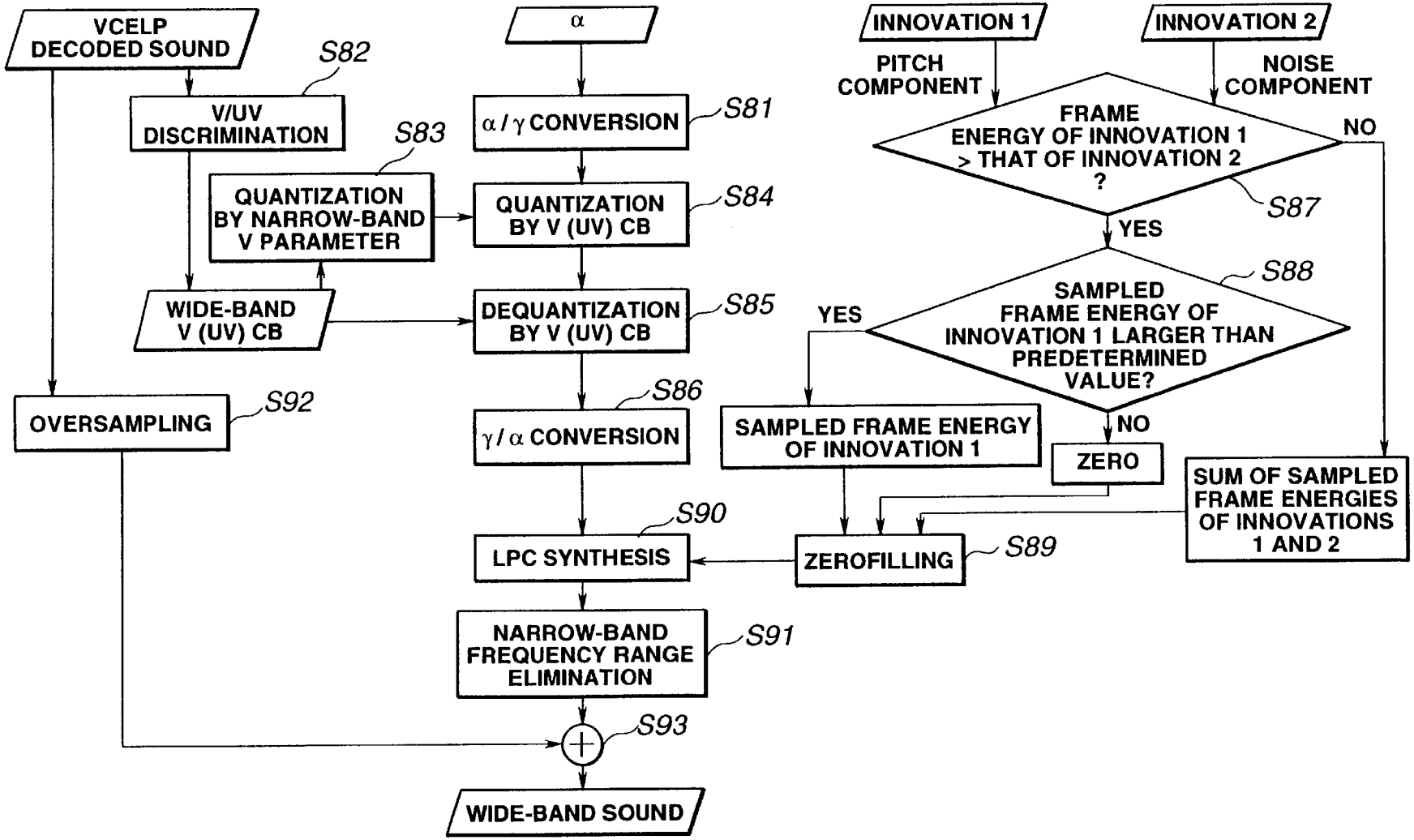
FIG. 14 is a flow chart of the operations of the sound synthesizer in FIG. 13.

The sound synthesizer in FIG. 13, being a block diagram of the sound synthesizer of the present invention employing the VSELP mode in a sound decoder thereof, is different from those shown in FIGS. 10 and 12 and employing the PSI-CELP mode in that the innovation selector 47 is provided upstream of the zerofilling circuit 16. When in the PSI-CELP mode, the CODEC (coder/decoder) processes the voiced sound signal to provide a fluent sound smooth to hear, while when in the VSELP mode, the CODEC provides a band-expanded sound containing some noise and thus not smooth to hear. To avoid this in the sound synthesizer employing the VSELP mode, the signal is processed by the innovation selector 47 as in FIG. 14 being a flow chart of the operations of the sound synthesizer in FIG. 13. The procedure in FIG. 14 are different from that in FIG. 11 only in that Steps S87 to S89 are additionally effected.

For the VSELP mode, the innovation is formed as beta*bL[i]+gammal*cl [i] from parameters beta (long-term prediction factor), bL[i] (long-term filtering), gamm1 (gain) and cl[i] (excited code vector) used in the CODEC. The beta*bL[i] represents a pitch component while the gamnmal*cl[i] represents a noise component. Therefore, the innovation is divided into beta*bL[i] and gamma*cl[i]. When the former shows a high energy for a predetermined time duration at Step S87, an input sound signal is considered to be a voiced one having a strong pitch. Therefore, the operation goes to YES at Step S88, to take an impulse train as the innovation. When the innovation is judged to have no pitch component, the operation goes to NO to suppress the innovation to 0. Also, when a narrow-band innovation thus formed is upsampled by zerofilling by the zerofilling circuit 16 as in the PSI-CELP mode at Step S89, thus producing a wide-band innovation. Thereby, the voiced sound produced in the VSELP mode has an improved quality for hearing.

Figure 15:
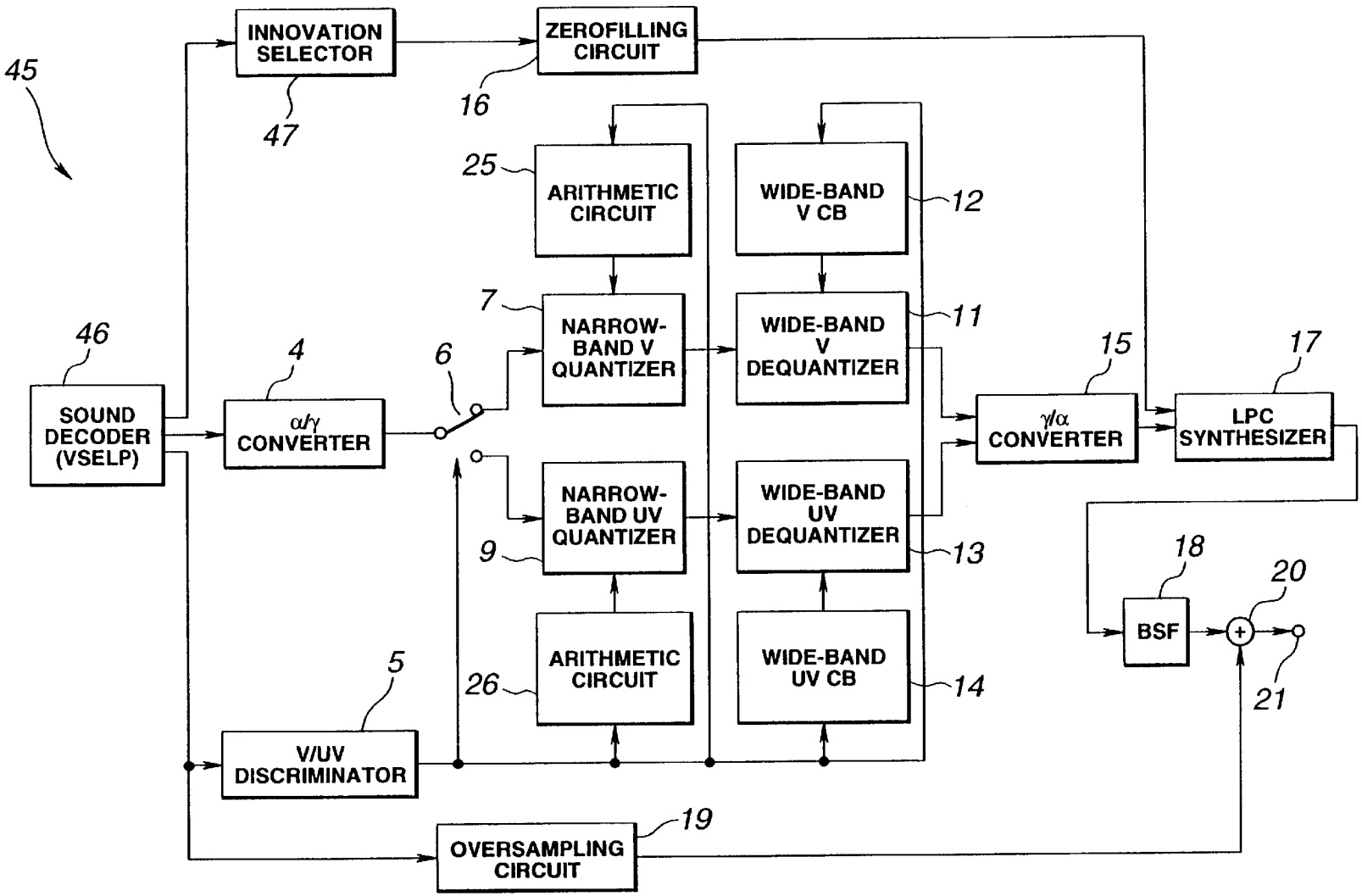
FIG. 15 is a block diagram of the sound synthesizer adopting the VSELP mode in the sound decoder thereof.

Furthermore, a sound synthesizer to synthesize a sound using coded parameters from the sound decoder 46 adopting the VSELP mode may be provided according to the present invention as shown in FIG. 15 being a block diagram of the sound synthesizer adopting the VSELP mode in the sound decoder thereof. The sound synthesizer in FIG. 15 comprises, in place of the partial-extraction circuits 28 and 29, arithmetic circuits 25 and 26 to provide narrow-band V (UV) parameters by calculation of each code vector in the wide-band sound code book. The rest of this sound synthesizer is configured similarly to that shown in FIG. 13.

This sound synthesizer in FIG. 15 can synthesize a sound using wide-band voiced and unvoiced sound code books 12 and 14, pre-formed using voiced and unvoiced sound parameters extracted from wide-band voiced and unvoiced sounds, as shown in FIG. 1, and a narrow-band voiced and unvoiced sound code books 8 and 10, pre-formed using voiced and unvoiced sounds parameters extracted from a narrow-band sound signal of 300 to 3,400 Hz in frequency band, produced by limiting the frequency band of the wide-band voiced sound, as also shown in FIG. 1.

This sound synthesizer is not limited to a prediction of a high frequency band from a low frequency band. Also, in a means for predicting a wide-band spectrum, the signal is not limited to a sound.

Furthermore, by taking an impulse train as the wide-band innovation when the sound pitch is strong, the quality of, in particular, a voiced sound for hearing can be improved according to the present invention.

What is claimed is:

1. A sound synthesizing method for synthesizing a sound from a plurality of coded parameters using a wide-band voiced sound code book and a wide-band unvoiced sound code book pre-formed from voiced and unvoiced sound characteristic parameters, respectively, extracted from wide-band voiced and unvoiced sounds separated at every predetermined time unit, and using a narrow-band voiced sound code book and a narrow-band unvoiced sound code book pre-formed from voiced and unvoiced sound characteristic parameters extracted from a narrow-band sound obtained by limiting a frequency band of the separated wide-band voiced and unvoiced sounds, the sound synthesizing method comprising the steps of:

decoding the plurality of coded parameters to form a plurality of decoded parameters;

forming an innovation-related parameter from a first one of the plurality of decoded parameters;

converting a second one of the plurality of decoded parameters to a sound synthesis characteristic parameter;

discriminating between the voiced and unvoiced sounds discriminable with reference to a third one of the plurality of decoded parameters;

quantizing the sound synthesis characteristic parameter based on a result of the step of discriminating by using the narrow-band voiced and unvoiced sound code books to form narrow-band voiced and unvoiced sound data;

dequantizing, by using the wide-band voiced and unvoiced sound code books, the narrow-band voiced and unvoiced sound data having been quantized using the narrow-band voiced and unvoiced sound code books and producing dequantized sound data; and synthesizing a sound based on the dequantized sound data and the innovation-related parameter.

2. The method as set forth in claim 1, wherein the plurality of coded parameters are obtained by encoding a narrow-band sound, the first one of the coded parameters is a parameter related to an innovation, the second one is a linear prediction factor, and the third one is a voiced/unvoiced sound discrimination flag.

3. The method as set forth in claim 1, wherein a discrimination between voiced and unvoiced sounds, effected for forming the wide-band voiced code book and unvoiced sound code book, is different than the step of discriminating using the third one of the plurality of decoded parameters.

4. The method as set forth in claim 3, further comprising the step of:

extracting parameters from an input sound, except for one in which no positive discrimination is possible between voiced and unvoiced sounds, for forming the wide-band voiced code book and the wide-band unvoiced sound code book and the narrow-band voiced code book and the narrow-band unvoiced sound code book.

5. The method as set forth in claim 1, wherein an autocorrelation is used as the characteristic parameter.

6. The method as set forth in claim 1, wherein a capstrum is used as the characteristic parameter.

7. The method as set forth in claim 1, wherein a spectrum envelope is used as the characteristic parameter.

8. The method as set forth in claim 1, wherein when a pitch component of the first coded parameter is judged to be strong, an impulse train is used as the innovation-related parameter.

9. A sound synthesizing apparatus for synthesizing a sound from a plurality of coded parameters, uses a wide-band voiced sound code book and wide-band unvoiced sound code book pre-formed from voiced and unvoiced sound characteristic parameters, respectively, extracted from wide-band voiced and unvoiced sounds separated at every predetermined time unit, and uses a narrow-band voiced sound code book and a narrow-band unvoiced sound code book pre-formed from voiced and unvoiced sound characteristic parameters extracted from a narrow-band sound obtained by limiting a frequency band of the separated wide-band voiced and unvoiced sounds, the apparatus comprising:

decoding means for decoding the plurality of coded parameters to form a plurality of decoded parameters, means for forming an innovation-related parameter from a first one of the plurality of decoded parameters decoded by the decoding means;

means for obtaining a sound synthesis characteristic parameter from a second one of the plurality of decoded parameters decoded by the decoding means;

means for discriminating between the voiced and unvoiced sounds with reference to a third one of the plurality of decoded parameters decoded by the decoding means;

sound quantizing means for quantizing the sound synthesis characteristic parameter based on a result of the discrimination by the means for discriminating of the voiced and unvoiced sounds by using the narrow-band voiced and unvoiced sound code books to form narrow-band voiced and unvoiced sound data;

sound dequantizing means for dequantizing the quantized voiced and unvoiced sound data from the sound quantizing means by using the wide-band voiced and unvoiced sound code books and producing dequantized data; and means for synthesizing a sound based on the dequantized data from the sound dequantizing means and the innovation-related parameter.

10. A sound synthesizing method for synthesizing sound from a plurality of coded parameters using a wide-band sound code book pre-formed from a characteristic parameter extracted from wide-band sounds at every predetermined time unit, comprising the steps of:

decoding the plurality of coded parameters and forming a plurality of decoded parameters;

forming an innovation-related parameter from a first one of the plurality of decoded parameters;

converting a second one of the plurality of decoded parameters to a sound synthesis characteristic parameter;

calculating a narrow-band characteristic parameter from each code vector in the wide-band sound code books;

quantizing the sound synthesis characteristic parameter by comparison with the narrow-band characteristic parameter calculated by the step of calculating and producing quantized data;

dequantizing the quantized data by using the wide-band sound code book and producing dequantized data; and synthesizing a sound based on the dequantized data and the innovation-related parameter.

11. The method as set forth in claim 10, the plurality of coded parameters are obtained by encoding a narrow-band sound, the first one of the plurality of coded parameters is a parameter related to an innovation, the second one is a linear prediction factor, and a third one is a voiced/unvoiced sound discriminating flag.

12. The method as set forth in claim 10, wherein when a pitch component of the first coded parameter is judged to be strong, an impulse train is used as the innovation-related parameter.

13. The method as set forth in claim 10, wherein an autocorrelation is used as the characteristic parameter, the autocorrelation is generated from the second one of the plurality of coded parameters; the autocorrelation is quantized by comparison with a narrow-band correlation determined by convolution between a wide-band autocorrelation in the wide-band sound code books and an autocorrelation of the impulse response of a band stop filter; and the quantized data is dequantized using the wide-band sound code books to synthesize a sound.

14. The method as set forth in claim 10, wherein the wide-band sound code books are wide-band voiced and unvoiced sound code books pre-formed from voiced and unvoiced sound characteristic parameters extracted from wide-band voiced and unvoiced sounds separated at every predetermined time unit; based on results of discriminating between the voiced and unvoiced sounds discriminable with reference to a third one of the plurality of coded parameters, the sound synthesis characteristic parameter is quantized by comparing with a narrow-band characteristic parameter determined by calculating from each code vector in the wide-band voiced and unvoiced sound code books; the quantized data is dequantized using the wide-band voiced and unvoiced sound code books; and a sound is synthesized based on the dequantized data and the innovation-related parameter.

15. The method as set forth in claim 14, wherein an autocorrelation is used as the characteristic parameter, the autocorrelation is generated from the second one of the plurality of coded parameters; the autocorrelation is quantized by comparing with a narrow-band correlation determined by convolution between a wide-band autocorrelation in the wide-band sound code books and an autocorrelation of the impulse response of a band stop filter; and the quantized data is dequantized using the wide-band sound code books to synthesize a sound.

16. The method as set forth in claim 14, wherein the descrimination between voiced and unvoiced sounds, effected for forming the wide-band voiced and unvoiced sound code books, is different from that using the third coded parameter.

17. The method as set forth in claim 14, further comprising the step of:

extracting parameters from an input sound, except for a one in which no positive discrimination is possible between voiced and unvoiced sounds, for forming unvoiced sound code books.

18. A sound synthesizing apparatus for synthesizing sound from a plurality of coded parameters, a wide-band sound code book pre-formed from a characteristic parameter extracted from wide-band sounds at every predetermined time unit, comprising:

means for decoding the plurality of coded parameters to form a plurality of decoded parameters;

means for forming an innovation-related parameter from a first one of the plural kinds of parameters decoded by the decoding means;

means for converting a second one of the plurality decoded parameters of the plural kinds of decoded parameters decoded by the means for decoding to a sound synthesis characteristic parameter;

means for calculating a narrow-band characteristic parameter from each code vector in the wide-band sound code book;

means for quantizing the sound synthesis characteristic parameter from the means for converting by using the narrow-band characteristic parameter from the means for calculating and producing quantized data;

means for dequantizing the quantized data from the means for quantizing by using the wide-band sound code book; and means for synthesizing a source based on the dequantized data from the means for dequantizing and the innovation-related parameter from the means for forming.

19. A sound synthesizing method for synthesizing a sound from a plurality of coded parameters, using a wide-band sound code book pre-formed from a characteristic parameter extracted from wide-band sounds at every predetermined time unit, the method comprising the steps of:

decoding the plurality of coded parameters and forming decoded parameters;

forming an innovation-related parameter from a first one of the decoded parameters;

converting a second one of the decoded parameters to a sound synthesis characteristic parameter;

calculating a narrow-band characteristic parameter, by partial extraction, from each code vector in the wide-band sound code book;

quantizing the sound synthesis characteristic parameter by comparison with the narrow-band characteristic parameter calculated in the step of calculating and producing quantized data;

dequantizing the quantized data by using the wide-band sound code book and producing dequantized data; and synthesizing a sound based on the dequantized data and the innovation-related parameter.

20. The method as set forth in claim 19, wherein the plurality of coded parameters are obtained by encoding a narrow-band sound, the first one of the coded parameters is a parameter related to an innovation, the second one is a linear prediction factor and a third one is a voiced/unvoiced sound discrimination flag.

21. The method as set forth in claim 19, wherein an autocorrelation is used as the characteristic parameter.

22. The method as set forth in claim 19, wherein a cepstrum is used as the characteristic parameter.

23. The method as set forth in claim 19, wherein a spectrum envelope is used as the characteristic parameter.

24. The method as set forth in claim 19, wherein when a pitch component of the first coded parameter is judged to be strong, an impulse train is taken as the innovation-related parameter.

25. A sound synthesizing method for synthesizing a sound from a plurality of input coded parameters, using a wide-band sound code book pre-formed from a characteristic parameter extracted from wide-band sounds at every predetermined time unit, the method comprising the steps of:

decoding the plurality of coded parameters and producing decoded parameters;

forming an innovation-related parameter from a first one of the decoded parameters;

converting a second one of decoded parameters to a sound synthesis characteristic parameter, calculating a narrow-band characteristic parameter, by partial extraction, from each code vector in the wide-band sound code book;

quantizing the sound synthesis characteristic parameter by comparison with the narrow-band characteristic parameter extracted in the step of calculating and producing quantized data;

dequantizing the quantized data by using the wide-band sound code book and producing dequantized data; and synthesizing a sound based on the dequantized data and the innovation-related parameter.

26. The method as set for the in claim 25, wherein an autocorrelation is used as the characteristic parameter.

27. The method as set forth in claim 25, wherein a cepstrum is used as the characteristic parameter.

28. The method as set forth in claim 25, wherein a spectrum envelope is used as the characteristic parameter.

29. The method as set forth in claim 25, wherein a discrimination between voiced and unvoiced sounds, effected for forming the wide-band voiced and unvoiced sound code books, is different from a discrimination using a third one of the decoded parameters.

30. The method as set forth in claim 25, further comprising the step of:

extracting parameters from an input sound, except for a one in which no positive discrimination is possible between voiced and unvoiced sounds, for forming the wide-band voiced and unvoiced sound code books and narrow-band voiced and unvoiced sound code books.

31. The method as set forth in claim 25, wherein when a pitch component of the first coded parameter is judged to be strong, an impulse train is taken as the innovation-related parameter.

32. A sound synthesizing apparatus for synthesizing a sound from a plurality of coded parameters using a wide-band sound code book pre-formed from a characteristic parameter extracted from wide-band sounds at every predetermined time unit, the apparatus comprising:

decoding means for decoding the plurality of coded parameters and producing a plurality of decoded parameters;

means for forming an innovation-related parameter from a first one of the plurality of decoded parameters from the decoding means;

parameter converting means for converting a second one of the plurality of the decoded parameters from the decoding means to a sound synthesis characteristic parameter;

calculating means for calculating a narrow-band characteristic parameter, by partial extraction, from each code vector in the wide-band sound code book;

quantizing means for quantizing the sound synthesis characteristic parameter from the parameter converting means by using the narrow-band characteristic parameter from the calculating means and producing quantized data;

dequantizing means for dequantizing the quantized data from the quantizing means by using the wide-band sound code book and producing dequantized data; and means for synthesizing a sound based on the dequantized data from the dequantizing means and the innovation-related parameter.

33. A sound band expanding method for expanding a band of an input narrow-band sound using a wide-band voiced sound code book and a wide band unvoiced sound code book pre-formed from voiced and unvoiced sound parameters, respectively, extracted from wide-band voiced and unvoiced sounds separated at every predetermined time unit, and using a narrow-band voiced sound code book and a narrow-band unvoiced sound code book pre-formed from voiced and unvoiced sound characteristic parameters extracted from a narrow-band sound obtained by limiting a frequency band of the wide-band voiced and unvoiced sounds, the method comprising the steps of:

discriminating between a voiced sound and an unvoiced sound in the input narrow-band sound at every predetermined time unit;

generating a voiced parameter and an unvoiced parameter from the narrow-band voiced and unvoiced sounds;

quantizing the narrow-band voiced parameter and the unvoiced sound parameter of the narrow-band sound by using the narrow-band voiced and unvoiced sound code books and generating narrow-band voiced and unvoiced sound data;

dequantizing, by using the wide-band voiced and unvoiced sound code books, the narrow-band voiced and unvoiced sound data having been quantized using the narrow-band voiced and unvoiced sound code books and generating dequantized data; and expanding the band of the narrow-band sound based on the dequantized data.

34. A sound band expanding apparatus for expanding a band of an input narrow-band sound, using a wide-band voiced sound code book and a wide-band unvoiced sound code book pre-formed from voiced and unvoiced sound parameters, respectively, extracted from wide-band voiced and unvoiced sounds separated at every predetermined time unit, and using a narrow-band voiced sound code book and a narrow-band unvoiced sound code book pre-formed from voiced and unvoiced sound characteristic parameters extracted from a narrow-band sound obtained by limiting a frequency band of the wide-band voiced and unvoiced sounds, the apparatus comprising:

voiced/unvoiced sound discriminating means for discriminating between a voiced sound and an unvoiced sound in the input narrow-band sound at every predetermined time unit;

means for generating a voiced parameter and an unvoiced parameter from the narrow-band voiced and unvoiced sounds discriminated by the voiced/unvoiced sound discriminating means;

quantizing means for quantizing the narrow-band voiced parameter and unvoiced sound parameter from the generated narrow-band voiced parameter and unvoiced parameter by using the narrow-band voiced and unvoiced sound code books and for generating narrow-band voiced and unvoiced sound data; and dequantizing means for dequantizing, by using the wide-band voiced and unvoiced sound code books, the narrow-band voiced and unvoiced sound data from the quantizing means by using the narrow-band voiced and unvoiced sound code books and producing dequantized data, wherein the band of the narrow-band sound is expanded based on the dequantized data from the dequantizing means.

35. A sound band expanding method for expanding a band of an input narrow-band sound using a wide-band sound code book pre-formed from a parameter extracted from wide-band sounds at every predetermined time unit, the method comprising the steps of:

generating a narrow-band parameter from the input narrow-band sound;

calculating a narrow-band parameter from each code vector in the wide-band sound code book;

quantizing the narrow-band parameter generated from the input narrow-band sound by comparison with the calculated narrow-band parameter;

dequantizing the quantized data by using the wide-band sound code book and producing dequantized data; and expanding a band of the narrow-band sound based on the dequantized data.

36. A sound band expanding apparatus for expanding a band of an input narrow-band sound using a wide-band sound code book pre-formed from parameters extracted from wide-band sounds at every predetermined time unit, the apparatus comprising:

generating means for generating a narrow-band parameter from the input narrow-band sound;

calculating means for calculating a narrow-band parameter from each code vector in the wide-band sound code book;

quantizing means for quantizing the narrow-band parameter from the generating means by comparison with the narrow-band parameter from the calculating means and producing quantized narrow-band data; and dequantizing means for dequantizing the quantized narrow-band data from the quantizing means by using the wide-band sound code book and producing dequantized data, wherein the band of the narrow-band sound being expanded is based on the dequantized data from the dequantizing means.

37. A sound band expanding method for expanding a band of an input narrow-band sound using a wide-band sound code book pre-formed from a parameter extracted from wide-band sounds at every predetermined time unit, the method comprising the steps of:

generating a narrow-band parameter from the input narrow-band sound;

calculating a narrow-band parameter, by partial extraction, from each code vector in the wide-band sound code book;

quantizing the narrow-band parameter generated from the input narrow-band sound in the step of generating by comparison with the calculated narrow-band parameter from the step of calculating and forming quantized data;

dequantizing the quantized data by using the wide-band sound code book and forming dequantized data; and expanding the band of the narrow-band sound based on the dequantized data.

38. A sound band expanding apparatus for expanding a band of an input narrow-band sound using a wide-band code book pre-formed from a parameter extracted from wide-band sounds at every predetermined time unit, the apparatus comprising:

generating means for generating a narrow-band parameter from the input narrow-band sound;

calculating means for calculating a narrow-band parameter, by partial extraction, from each code vector in the wide-band sound code book;

quantizing means for quantizing the narrow-band parameter generating from the generating means by using the narrow-band parameter from the calculating means and producing quantized narrow-band data; and dequantizing means for dequantizing the quantized narrow-band data from the quantizing means by using the wide-band sound code book and producing dequantized data, wherein the band of the narrow-band sound being expanded is based on the dequantized data from the dequantizing means.

* * * * *